US012729083B2

(12) United States Patent
Mitorida et al.

(10) Patent No.: US 12,729,083 B2
(45) Date of Patent: Sep. 8, 2026

(54) FEEDING DEVICE AND IMAGE FORMING APPARATUS

(71) Applicant: FUJIFILM Business Innovation Corp., Tokyo (JP)

(72) Inventors: Shinya Mitorida, Kanagawa (JP); Shohei Matsunami, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 309 days.

(21) Appl. No.: 18/189,202

(22) Filed: Mar. 23, 2023

(65) Prior Publication Data

US 2024/0076151 A1 Mar. 7, 2024

(30) Foreign Application Priority Data

Sep. 7, 2022 (JP) ..... 2022-142569

(51) Int. Cl.
*B65H 3/48* (2006.01)
*B65H 3/08* (2006.01)

(52) U.S. Cl.
CPC ..... *B65H 3/08* (2013.01); *B65H 2511/13* (2013.01); *B65H 2515/805* (2013.01)

(58) Field of Classification Search
CPC ..... B65H 3/48; B65H 7/02; B65H 2511/13; B65H 2511/20; B65H 2511/414; B65H 2515/805; B65H 2801/06
USPC ..... 271/97
See application file for complete search history.

(56) References Cited

U.S. PATENT DOCUMENTS 6,015,144 A * 1/2000 Yoshii ..... B65H 3/48 271/97
6,543,759 B2 * 4/2003 Yamaguchi ..... B65H 3/48 271/104
6,595,511 B2 * 7/2003 Goda ..... B65H 3/48 271/98
6,955,348 B2 10/2005 Koga
8,113,501 B2 * 2/2012 Uji ..... B65H 3/48 271/97
8,141,864 B2 * 3/2012 Fukumoto ..... B65H 3/56 271/97
2017/0327329 A1 11/2017 Takahashi et al.
(Continued)

FOREIGN PATENT DOCUMENTS

JP H115643 1/1999
JP 2004284783 10/2004
JP 2016124667 7/2016

OTHER PUBLICATIONS

"Search Report of Europe Counterpart Application", issued on Feb. 6, 2024, p. 1-p. 8.

(Continued)

*Primary Examiner* — Leslie A Nicholson, III
(74) *Attorney, Agent, or Firm* — JCIPRNET

(57) ABSTRACT

A feeding device includes a blowing unit that floats a plurality of stacked media by blowing air to side end portions of the media and that has a first blowing unit which blows the air from a defined region to the media and a second blowing unit which blows the air from a changing region to the media, a feeding unit that feeds the floating media, and a control unit that has a control mode in which the first blowing unit and the second blowing unit simultaneously perform air blowing on the media.

17 Claims, 22 Drawing Sheets

(56) References Cited

U.S. PATENT DOCUMENTS

2020/0071102 A1* 3/2020 Masuda ..... B65H 5/228

OTHER PUBLICATIONS

"Notice of Reasons for Refusal of Japan Counterpart Application", issued on May 26, 2026, with English translation thereof, p. 1-p. 6.

* cited by examiner

FEEDING DEVICE AND IMAGE FORMING APPARATUS

CROSS-REFERENCE TO RELATED APPLICATIONS

This application is based on and claims priority under 35 USC 119 from Japanese Patent Application No. 2022-142569 filed Sep. 7, 2022.

BACKGROUND

(i) Technical Field

The present disclosure relates to a feeding device and an image forming apparatus.

(ii) Related Art

JP1999-5643A discloses an image forming apparatus that includes a paper feeding tray on which paper is stacked, paper feeding means for feeding the paper from the paper feeding tray, and air blowing means for blowing air to a side surface and an upper surface of the stacked paper from a direction perpendicular to the side surface of the paper, in which an air refinement unit that shrinks the area of an air blowing port as being disposed to face the side surface of the paper and that refines an air flow blown from the air blowing port is formed at an air blowing port of the air blowing means.

SUMMARY

Aspects of non-limiting embodiments of the present disclosure relate to a feeding device and an image forming apparatus that stabilize the posture of top floating paper compared to a case where air is blown only from a changing region for floating a medium to a side end portion of the medium.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a feeding device including a blowing unit that floats a plurality of stacked media by blowing air to side end portions of the media and that has a first blowing unit which blows the air from a defined region to the media and a second blowing unit which blows the air from a changing region to the media, a feeding unit that feeds the floating media, and a control unit that has a control mode in which the first blowing unit and the second blowing unit simultaneously perform air blowing on the media.

BRIEF DESCRIPTION OF THE DRAWINGS

Exemplary embodiment(s) of the present invention will be described in detail based on the following figures, wherein.

DETAILED DESCRIPTION

Hereinafter, an example of an exemplary embodiment according to the present disclosure will be described based on the drawings.

Image Forming Apparatus 10

Figure 1:
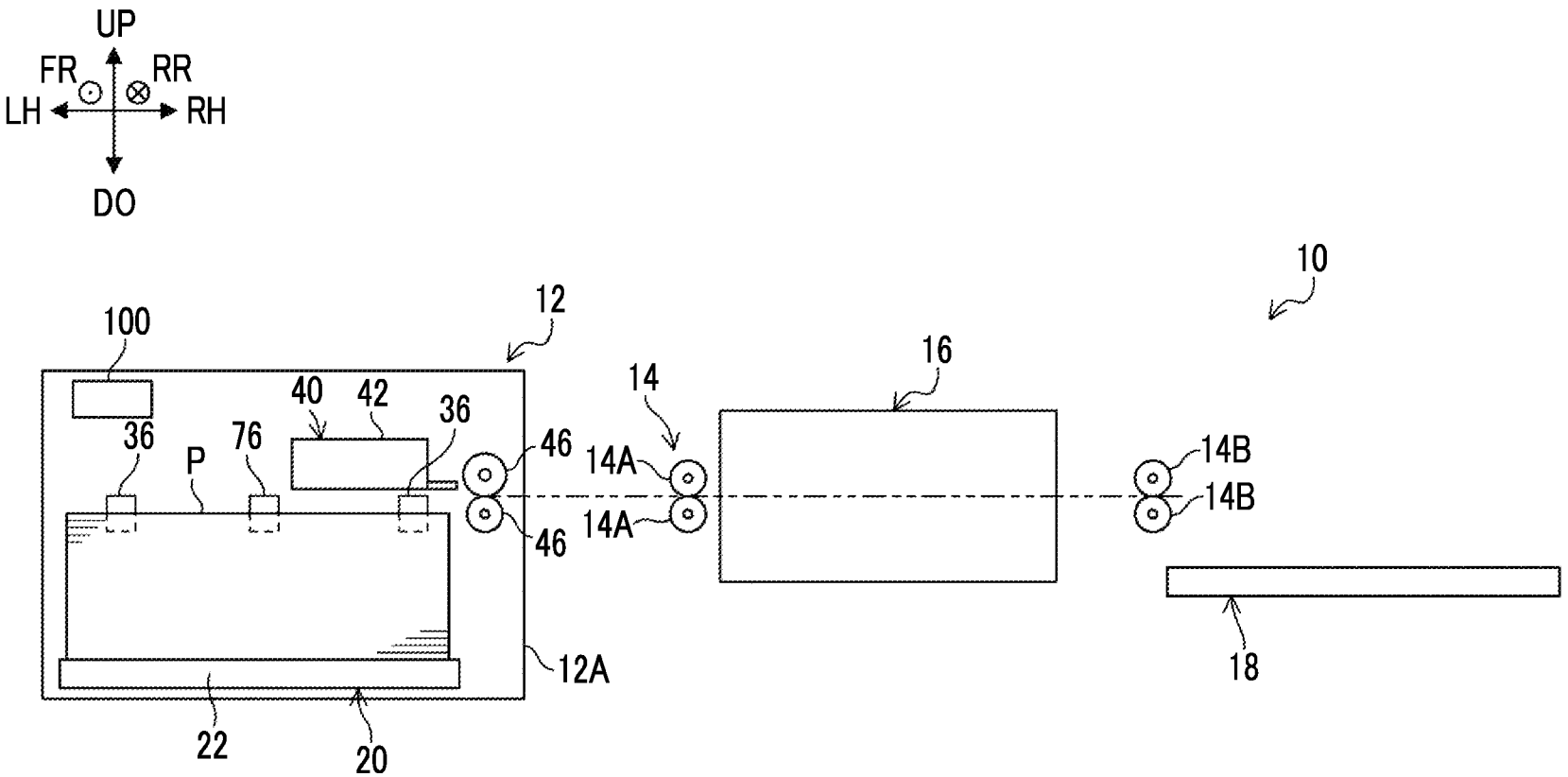
FIG. 1 is a schematic view showing an image forming apparatus according to the present exemplary embodiment.

First, a configuration of an image forming apparatus 10 according to the present exemplary embodiment will be described. FIG. 1 is a schematic view showing a configuration of the image forming apparatus 10 according to the present exemplary embodiment.

An arrow UP shown in the drawings indicates an upward direction of the apparatus (specifically, a vertically upward direction), and an arrow DO indicates a downward direction of the apparatus (specifically, a vertically downward direction). In addition, an arrow LH shown in the drawings indicates a leftward direction of the apparatus, and an arrow RH indicates a rightward direction of the apparatus. In addition, an arrow FR shown in the drawings indicates a forward direction of the apparatus, and an arrow RR indicates a rearward direction of the apparatus. Since the directions are directions determined for convenience of description, an apparatus configuration is not limited to the directions. The term "apparatus" in each direction of the apparatus is omitted in some cases. That is, for example, the "upward direction of the apparatus" is simply referred to as the "upward direction" in some cases.

In addition, in the following description, an "up-down direction" is used to mean "both of the upward direction and the downward direction" or "any one of the upward direction or the downward direction" in some cases. A "right-left direction" is used to mean "both of the rightward direction and the leftward direction" or "any one of the rightward direction or the leftward direction" in some cases. The "right-left direction" can also be referred to as sideways, a lateral direction, and a horizontal direction. A "front-rear direction" is used to mean "both of the forward direction and the rearward direction" or "any one of the forward direction or the rearward direction" in some cases. The "front-rear direction" can also be referred to as sideways, a lateral direction, and a horizontal direction. In addition, the up-down direction, the right-left direction, and the front-rear direction are directions intersecting each other (specifically, directions orthogonal to each other).

In addition, a symbol in which "x" is written in "○" in the drawings means an arrow from the front toward the back of the page. In addition, a symbol in which "•" is written in "○" in the drawings means an arrow from the back toward the front of the page.

The image forming apparatus 10 shown in FIG. 1 is an apparatus that forms an image on a recording medium P which is an example of a medium. Specifically, as shown in FIG. 1, the image forming apparatus 10 includes a feeding device 12, a transporting unit 14, an image forming unit 16, and a discharging unit 18. Hereinafter, each unit of the image forming apparatus 10 will be described.

Transporting Unit 14

The transporting unit 14 shown in FIG. 1 is a configuration unit that transports the recording medium Pin the image forming apparatus 10. The transporting unit 14 has a function of transporting the recording medium P fed from the feeding device 12 to the image forming unit 16 and a function of transporting the recording medium P on which an image is formed by the image forming unit 16 to the discharging unit 18.

Specifically, the transporting unit 14 has transporting members 14A and 14B configured by a pair of transport rollers. In the transporting unit 14, the transporting member 14A transports the recording medium P fed from the feeding device 12 to the image forming unit 16, and the transporting member 14B transports the recording medium P on which the image is formed by the image forming unit 16 to the discharging unit 18.

The transporting members 14A and 14B are not limited to the pair of transport rollers. The transporting members 14A and 14B may be, for example, transporting members such as a transport belt and a transport drum, and it is possible to use various transporting members.

Image Forming Unit 16

The image forming unit 16 shown in FIG. 1 is a configuration unit that forms an image on the recording medium P fed from the feeding device 12. Examples of the image forming unit 16 include an inkjet image forming unit that forms an image on the recording medium using inks and an electrophotographic image forming unit that forms an image on the recording medium using toners.

In the inkjet image forming unit, for example, ink droplets are jetted to the recording medium from a jetting unit, and an image is formed on the recording medium. The inkjet image forming unit may form an image on the recording medium as the jetting unit jets ink droplets to a transfer body and the ink droplets are transferred from the transfer body to the recording medium.

The electrophotographic image forming unit performs, for example, each of processes, such as charging, exposing, developing, and transferring, and forms an image on the recording medium. As each of the processes, such as charging, exposing, developing, and transferring, is performed to form an image on the transfer body and the image is transferred from the transfer body to the recording medium, the electrophotographic image forming unit may form the image on the recording medium.

Examples of the image forming unit are not limited to the inkjet image forming unit described above and the electrophotographic image forming unit described above, and various image forming units can be used.

Discharging Unit 18

The discharging unit 18 shown in FIG. 1 is a portion to which the recording medium on which an image is formed is discharged in the image forming apparatus 10. After the image is formed by the image forming unit 16, the recording medium P transported by the transporting unit 14 (specifically, the transporting member 14B) is discharged to the discharging unit 18.

Feeding Device 12

Figure 2:
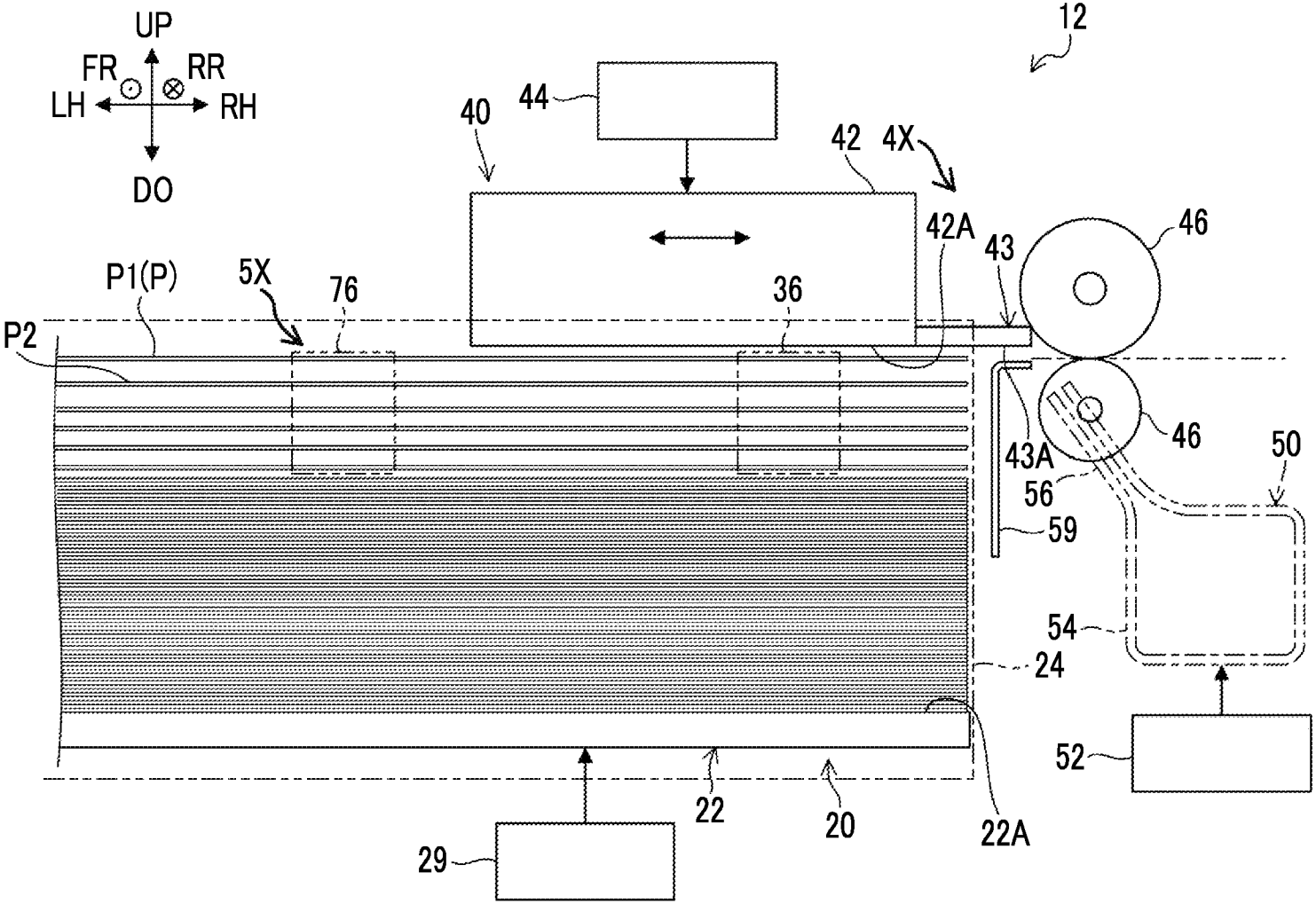
FIG. 2 is a schematic view showing an accommodating unit and a feeding unit of a feeding device according to the present exemplary embodiment.
Figure 3:
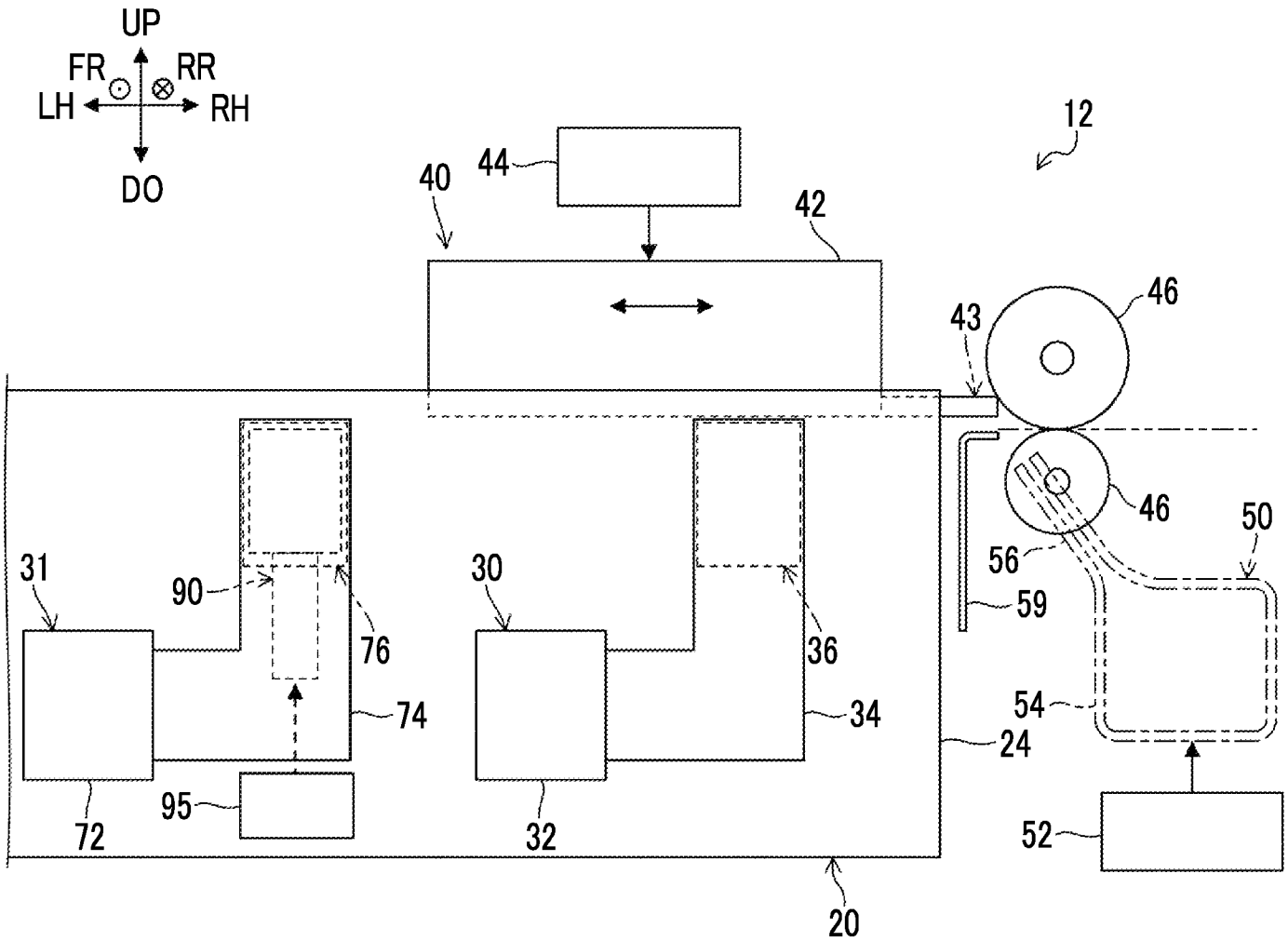
FIG. 3 is a view of the feeding device according to the present exemplary embodiment, which is viewed from an outer surface side of a side wall.

The feeding device 12 shown in FIGS. 1, 2, and 3 is a device that feeds the recording medium P. In the present exemplary embodiment, the feeding device 12 feeds the recording medium P in a feeding direction (specifically, the rightward direction) determined in advance. Therefore, in the feeding device 12, the rightward direction is a downstream side in the feeding direction, and the leftward direction is an upstream side in the feeding direction. In addition, in the recording medium P fed from the feeding device 12, a downstream end portion in the feeding direction will be referred to as a leading end portion, and an upstream end portion in the feeding direction will be referred to as a trailing end portion. In addition, in the recording medium P, a direction (specifically, the front-rear direction) intersecting the feeding direction will be referred to as a width direction, and an end portion in the width direction will be referred to as a side end portion.

Figure 21:
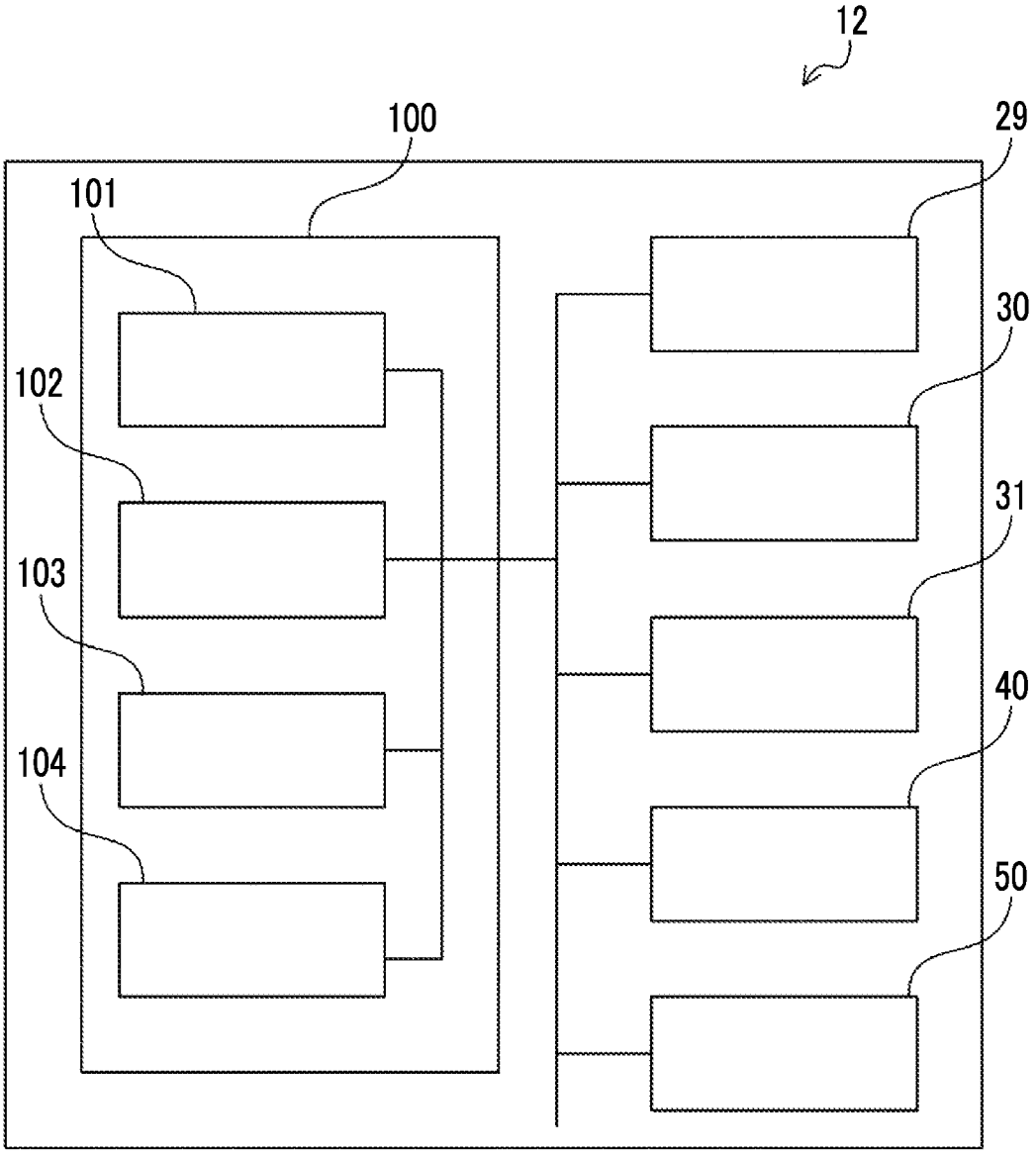
FIG. 21 is a block diagram showing an example of a functional configuration of a control device of the feeding device according to the present exemplary embodiment.

Specifically, as shown in FIGS. 2 and 3, the feeding device 12 includes an accommodating unit 20, a lifting and lowering unit 29 (see FIG. 2), a blowing unit 30, a blowing unit 31 (see FIG. 3), a feeding unit 40, a separating unit 50, a restricting unit 59, and a control device 100 (see FIGS. 1 and 21). Hereinafter, each unit of the feeding device 12 will be described.

Accommodating Unit 20 and Lifting and Lowering Unit 29

The accommodating unit 20 is a configuration unit that accommodates the recording medium P. Specifically, as shown in FIG. 2, the accommodating unit 20 has a stacking portion 22 and a pair of side walls 24. FIG. 2 shows one side wall 24 (specifically, a forward side) of the pair of side walls 24.

The stacking portion 22 is a configuration unit on which the recording media P are stacked. Specifically, the stacking portion 22 configures a bottom portion of the accommodating unit 20 and is configured by a stacking plate (so-called bottom plate) having an upper surface 22A on which the recording media P are stacked.

Each of the pair of side walls 24 is disposed on each of the forward side and a rearward side with respect to the recording media P stacked on the stacking portion 22. Each of the pair of side walls 24 faces each of a pair of side end portions of the recording media P stacked on the stacking portion 22, and the recording media P are positioned in the width direction (that is, the front-rear direction).

The accommodating unit 20 has a positioning unit (not shown) that positions the trailing end portions of the recording media P stacked on the stacking portion 22. The accommodating unit 20 is not limited to the configuration, and various configurations can be used.

The lifting and lowering unit 29 is a configuration unit that lifts and lowers the recording medium P accommodated in the accommodating unit 20. Specifically, the lifting and lowering unit 29 lifts the recording medium P such that the uppermost recording medium P is positioned at a height determined in advance (hereinafter, referred to as a feeding height) by lifting the stacking portion 22 and lowers the recording medium P by lowering the stacking portion 22.

For example, a pulling member, such as a wire, a pushing member, such as an arm, and the like can be used as the lifting and lowering unit 29. For example, the recording medium P is lifted as the stacking portion 22 is pulled upward by the pulling member, and the recording medium P is lowered by the weights of the recording medium P and the stacking portion 22. For example, the recording medium P is lifted as the stacking portion 22 is pushed upward from a lower side of the stacking portion 22 by the pushing member, and the recording medium P is lowered by the weights of the recording medium P and the stacking portion 22. The lifting and lowering unit 29 is not limited to the configuration, and various configurations can be used.

Blowing Unit 30 and Blowing Unit 31

Figure 4:
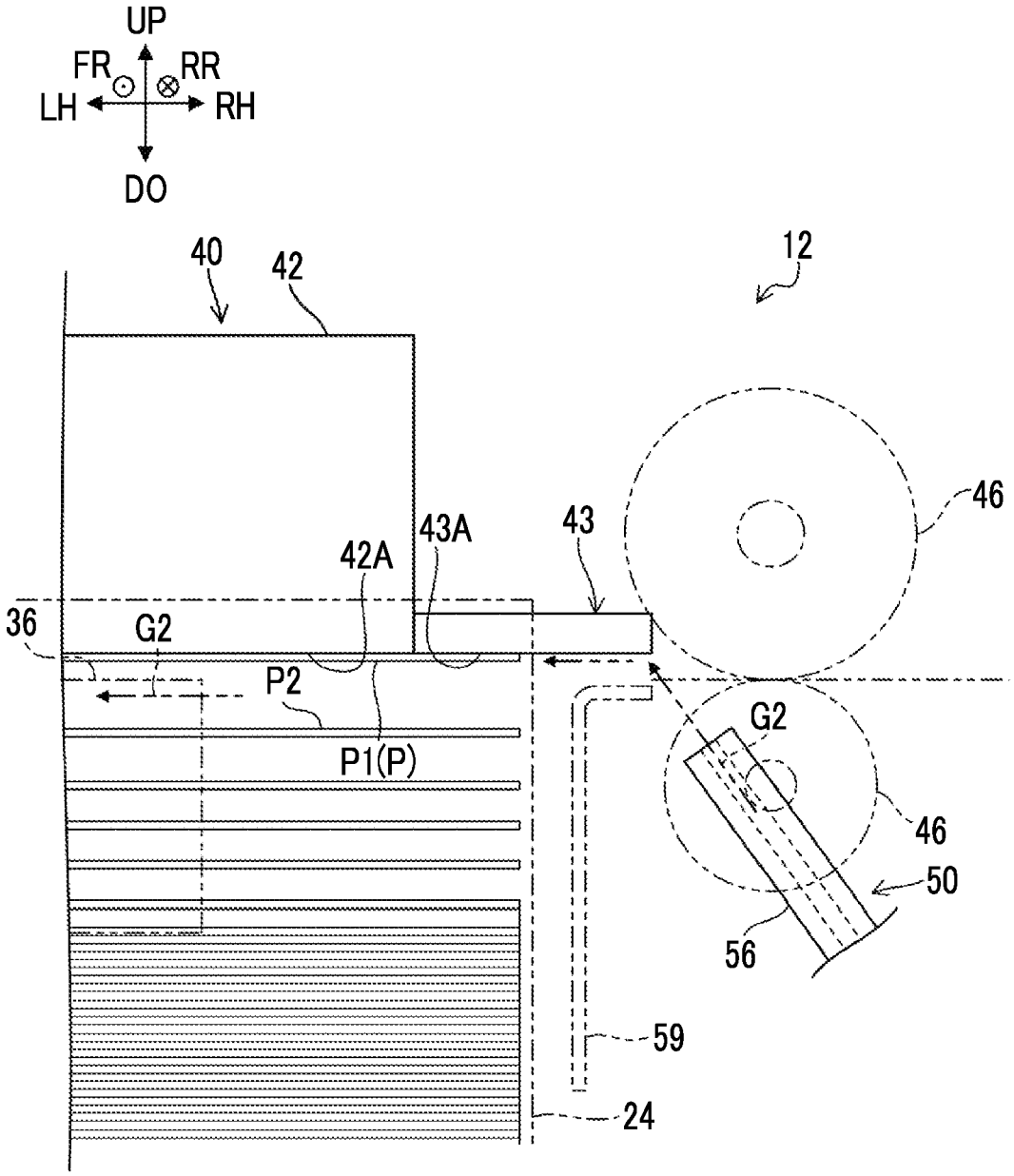
FIG. 4 is an enlarged view of a portion of the feeding device shown in FIG. 2, which is indicated by an arrow 4X, and is a view showing a state where the feeding unit makes an uppermost recording medium stick thereto.
Figure 5:
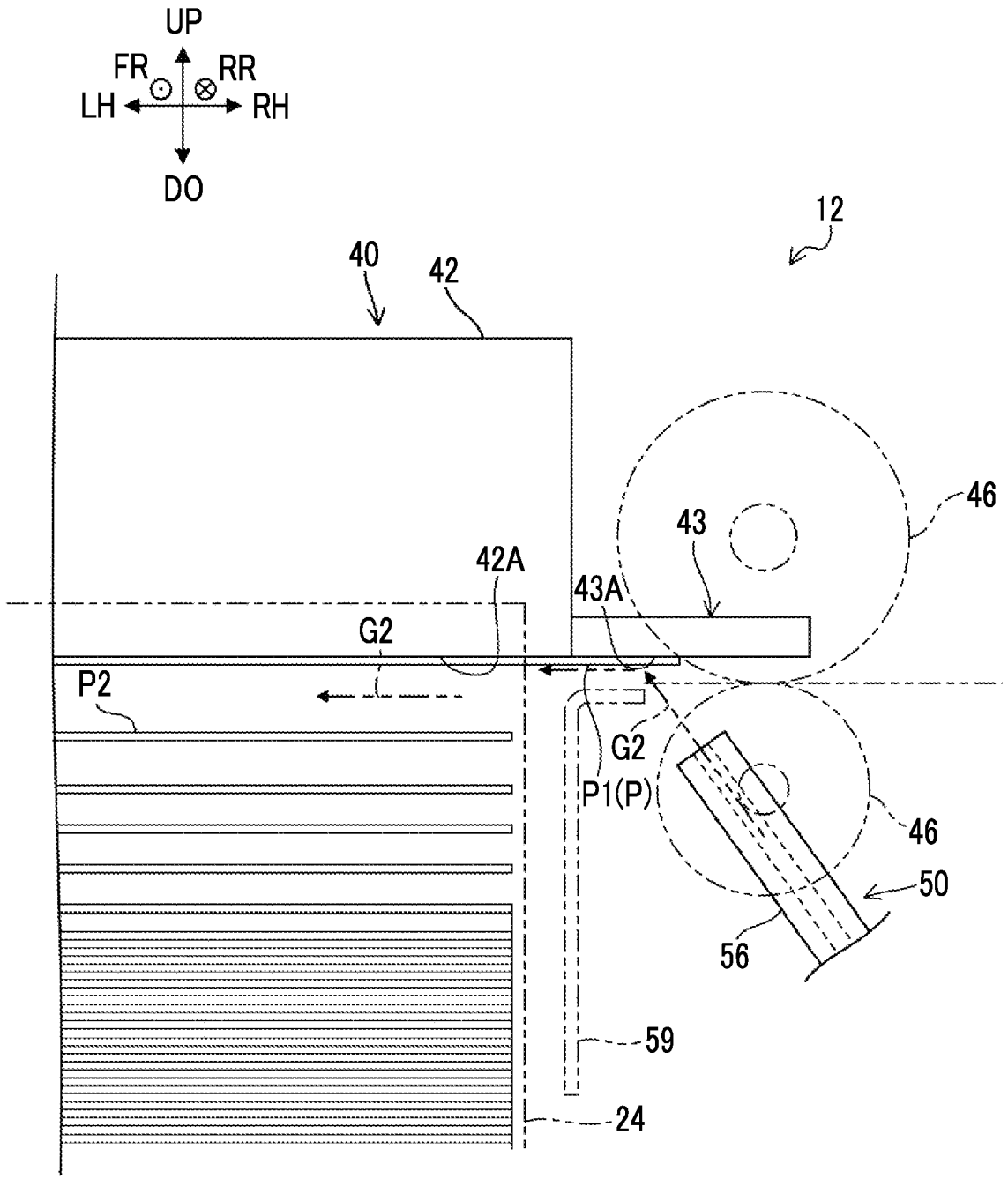
FIG. 5 is a schematic view showing a state where the feeding unit of the feeding device shown in FIG. 4 is moved to a delivery position.

The blowing unit 30 and the blowing unit 31 shown in FIGS. 2 and 3 are configuration units that blow air between a plurality of stacked recording media P and that float the recording media P. Specifically, the blowing unit 30 and the blowing unit 31 are configuration units that float the recording media P by blowing air to the side end portions of the plurality of stacked recording media P. Hereinafter, air blown from the blowing unit 30 and the blowing unit 31 toward the recording media P is indicated by the reference sign G1. The blowing unit 30 and the blowing unit 31 blow the air G1 to the plurality of recording media P positioned in a range determined in advance, including the uppermost recording medium P, among the plurality of recording media P stacked on the stacking portion 22. That is, the blowing unit 30 and the blowing unit 31 blow the air G1 to the plurality of recording media P stacked on the stacking portion 22 in a range from the feeding height to a position thereunder determined in advance. Herein, floating the recording media P as the blowing unit 30 and the blowing unit 31 blow the air G1 between the plurality of stacked recording media P is to separate the plurality of recording media P from each other one by one and to feed one by one by blowing the air G1 between the plurality of recording media P respectively. FIGS. 2, 4, and 5 schematically show a state where the air G1 is blown to an upper portion of the plurality of stacked recording media P for floating.

In the present exemplary embodiment, as shown in FIG. 3, the blowing unit 30 has a pair of blowers 32, a pair of blowing pipes 34, and a pair of blowing port units 36.

The pair of blowers 32 are devices that send wind (that is, the air G1). Each of the pair of blowers 32 is attached to an outer surface (that is, a surface on an opposite side to a surface facing the recording media P stacked on the stacking portion 22) of each of the pair of side walls 24. For example, centrifugal blowers that blow air in a centrifugal direction, such as multi-blade blowers (for example, sirocco fans), are used as the blowers 32. Axial flow blowers that blow air in an axial direction and other blowers may be used as the blowers 32.

Each of the pair of blowing pipes 34 configures a passage through which the air G1 sent from each of the pair of blowers 32 passes. One end portion of each of the pair of blowing pipes 34 is connected to each of the pair of blowers 32, and the other end portion is connected to each of the pair of blowing port units 36.

Each of the pair of blowing port units 36 is an outlet unit of the blowing pipe 34 for blowing the air G1 to the plurality of recording media P stacked on the stacking portion 22 and is provided in each of the pair of side walls 24. Each of the pair of blowing port units 36 is open in an upper portion of the side wall 24.

The blowing port unit 36 is provided with a louver 38 having a plurality of blade plates. A direction of the air G1 (blowing direction) fed (blown) from the blowing port unit 36 is determined by a direction of the blade plates configuring the louver 38. Although the blade plates of the present exemplary embodiment extend in the up-down direction as an example, the present disclosure is not limited thereto, and the blade plates may extend in the right-left direction. Further, the direction of the blade plates may be configured to be changed. The blowing direction of the air G1 can be changed by changing the direction of the blade plates.

In addition, as shown in FIG. 1, a plurality of blowing units 30 are provided at intervals in the feeding direction (right-left direction) of the recording medium P. Specifically, two blowing units 30 are provided at an interval in the feeding direction (right-left direction) of the recording medium P. Then, the air G1 is blown from the blowing unit 30 that is on a leading end portion side of the plurality of stacked recording media P and that is on a downstream side in the feeding direction with respect to both side end portions of the recording media P. In addition, the air G1 is blown from the blowing unit 30 that is on a trailing end portion side of the plurality of stacked recording media P and that is on an upstream side in the feeding direction with respect to both side end portions of the recording media P.

The blowing unit 30 may blow the air G1 between the plurality of stacked recording media P, that is, to at least one side end portion side of side end portion sides of the recording media P. In addition, three or more blowing units 30 may be provided at intervals in the right-left direction, or one blowing unit 30 may be provided. In a case of providing only one blowing unit 30, the blowing unit 30 may be disposed at a position where the air G1 can be blown to the leading end portion side of the plurality of recording media P, for example, on the downstream side in the feeding direction.

In the present exemplary embodiment, as shown in FIG. 3, the blowing unit 31 has a pair of blowers 72, a pair of blowing pipes 74, and a pair of blowing port units 76.

The pair of blowers 72 are devices that send wind (that is, air). Each of the pair of blowers 72 is attached to the outer surface (that is, the surface on the opposite side to the surface facing the recording media P stacked on the stacking portion 22) of each of the pair of side walls 24. For example, centrifugal blowers that blow air in a centrifugal direction, such as multi-blade blowers (for example, sirocco fans) are used as the blowers 72. Axial flow blowers that blow air in an axial direction and other blowers may be used as the blowers 72.

Each of the pair of blowing pipes 74 configures a passage through which air sent from each of the pair of blowers 72 passes. One end portion of each of the pair of blowing pipes 74 is connected to each of the pair of blowers 72, and the other end portion is connected to each of the pair of blowing port units 76.

Each of the pair of blowing port units 76 is an outlet unit of the blowing pipe 74 that blows air to the plurality of recording media P stacked on the stacking portion 22 and is provided in each of the pair of side walls 24. Each of the pair of blowing port units 76 is open in the upper portion of the side wall 24.

Figure 9:
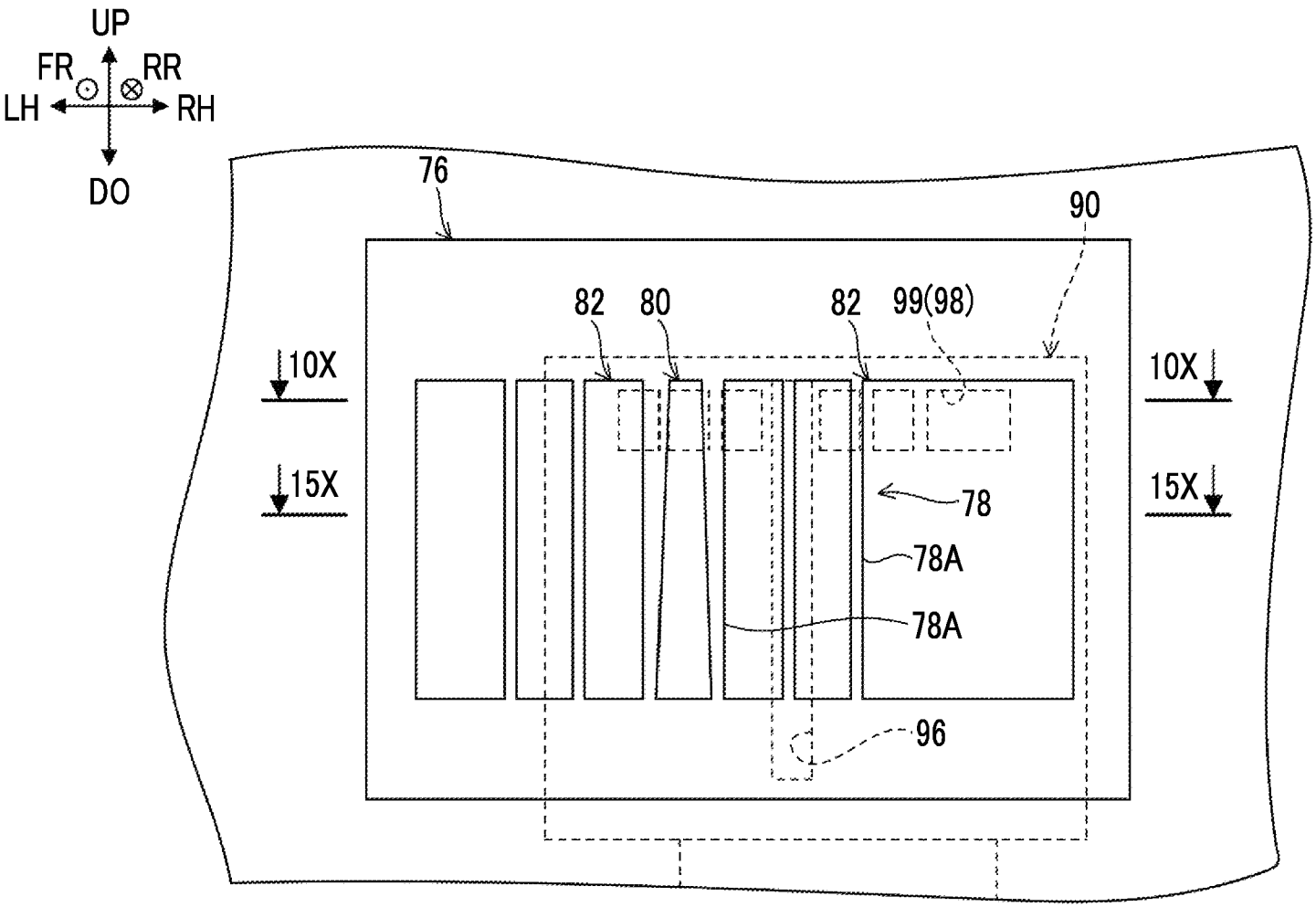
FIG. 9 is a view of a blowing port of a blowing unit used in the feeding device according to the present exemplary embodiment, which is viewed from an inner surface side of the side wall, and shows the moving member positioned at a second position.
Figure 10:
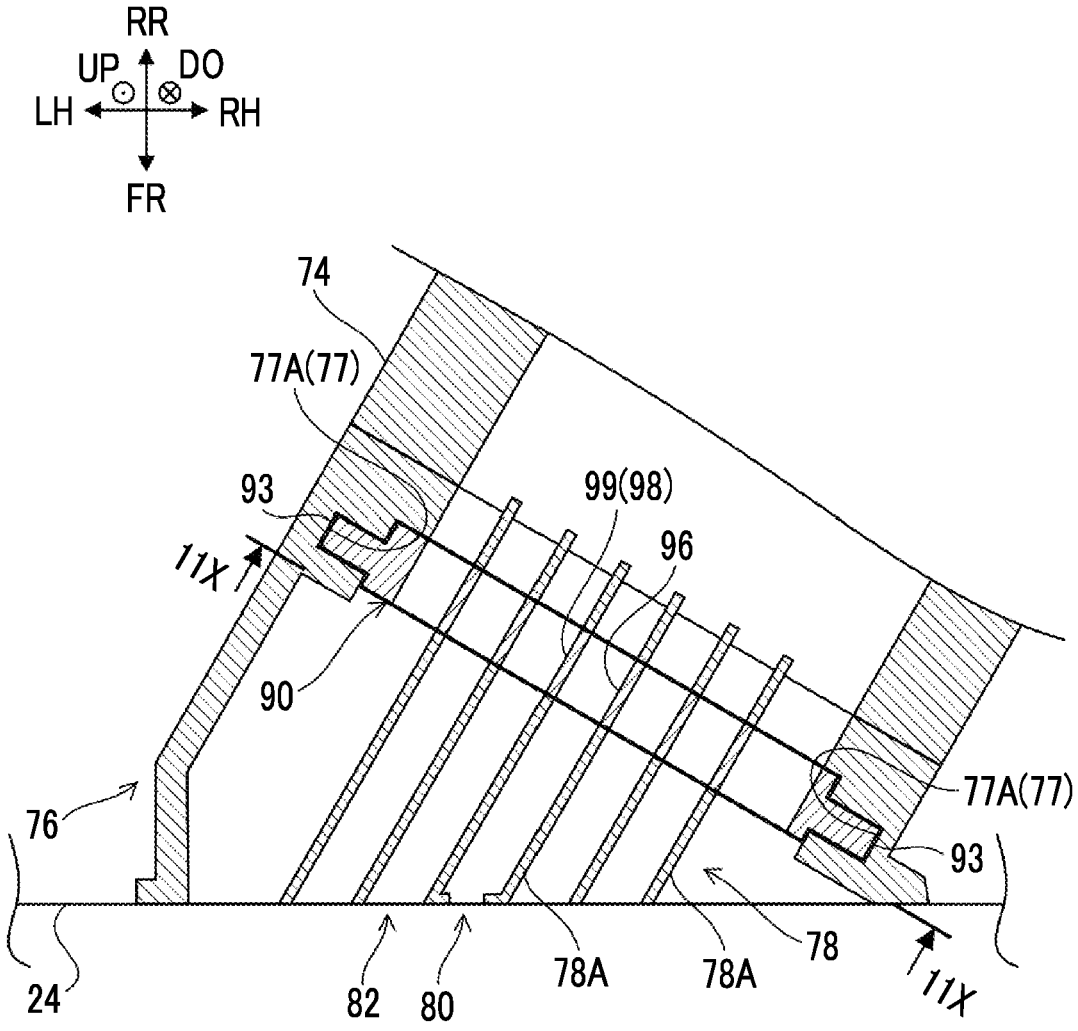
FIG. 10 is a sectional view taken along line 10X-10X of FIG. 9.
Figure 11:
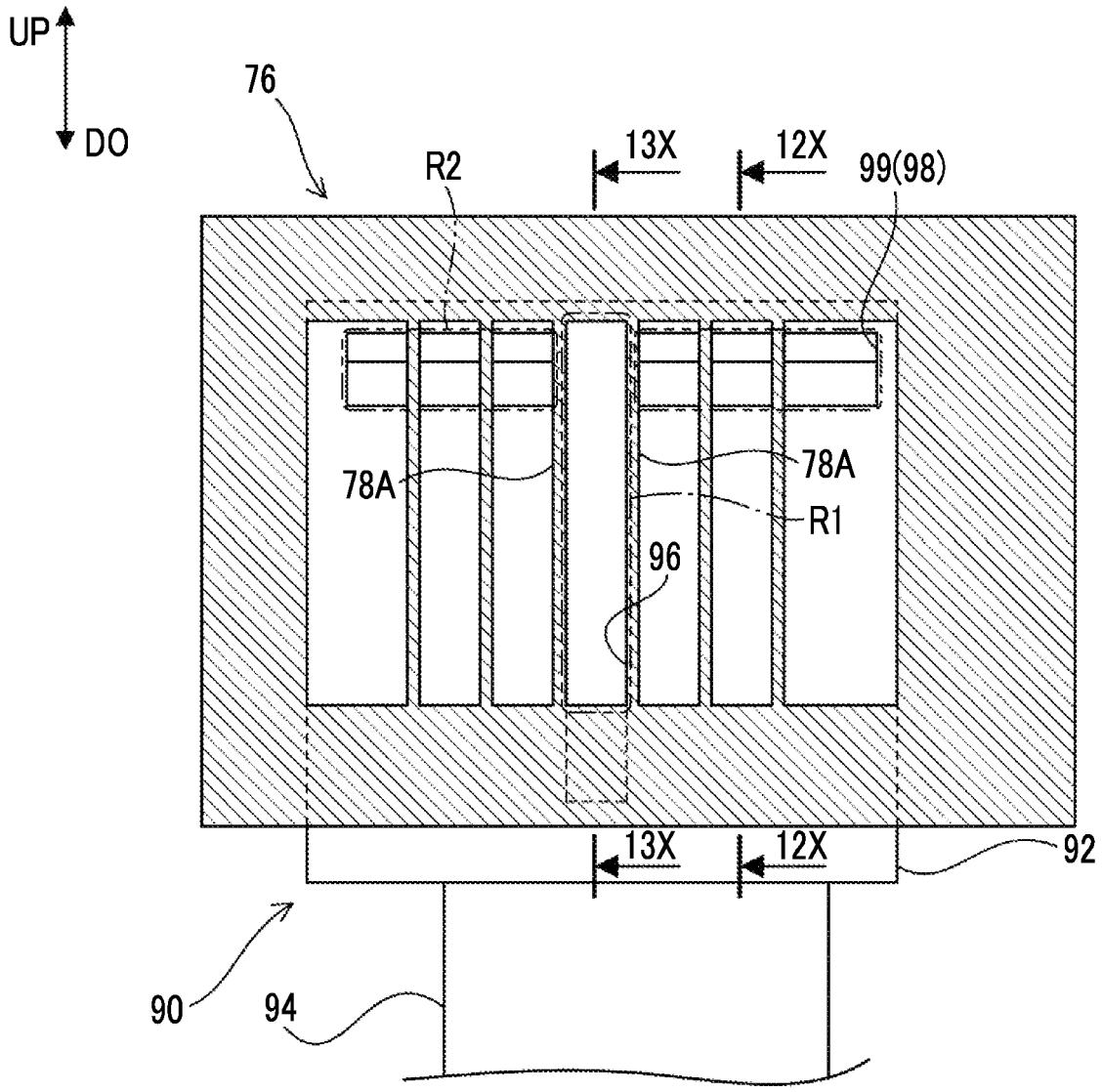
FIG. 11 is a sectional view taken along line 11X-11X of FIG. 10.

The blowing port unit 76 is provided with a louver 78 having a plurality of blade plates 78A, as shown in FIGS. 9 to 11. The blowing direction of the air G1 fed from the blowing port unit 76 is determined by a direction of the blade plates 78A configuring the louver 78. Although the blade plates 78A of the present exemplary embodiment extend in the up-down direction as an example, the present disclosure is not limited thereto, and the blade plates 78A may extend in the right-left direction. Further, the direction of the blade plates 78A may be configured to be changed. The blowing direction of the air G1 can be changed by changing the direction of the blade plates 78A.

In addition, as shown in FIG. 9, the blowing unit 31 has a first blowing unit 80, a second blowing unit 82, and a moving member 90. The first blowing unit 80 and the second blowing unit 82 configure the blowing port unit 76.

Figure 18:
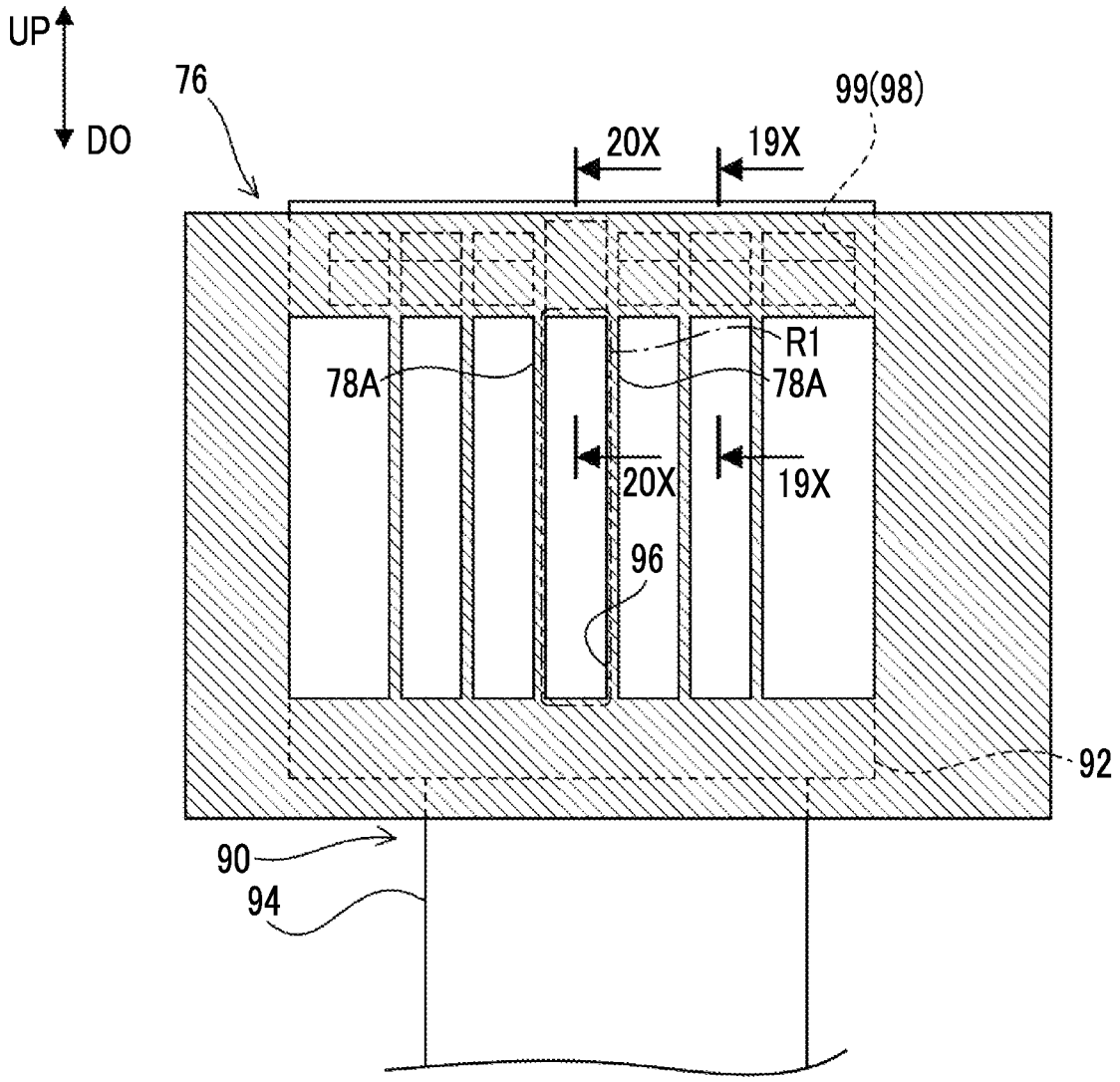
FIG. 18 is a sectional view taken along line 18X-18X of FIG. 17.

As shown in FIGS. 11 and 18, the first blowing unit 80 is a configuration unit that blows the air G1 to the recording medium P from a defined region R1. The defined region R1 herein refers to a region of an opening that is a part of the blowing port unit 76 and that is surrounded by a one-dot chain line in FIGS. 11 and 18. In addition, as shown in FIGS. 11 and 18, a position of the region R1 in the up-down direction does not change in response to a vertical movement of the moving member 90, in other words, the position in the up-down direction is determined. Further, in the region R1 of the present exemplary embodiment, a blowing area (in other words, an opening area) for blowing the air G1 does not change in response to the movement of the moving member 90, that is, the blowing area is constant.

Figure 19:
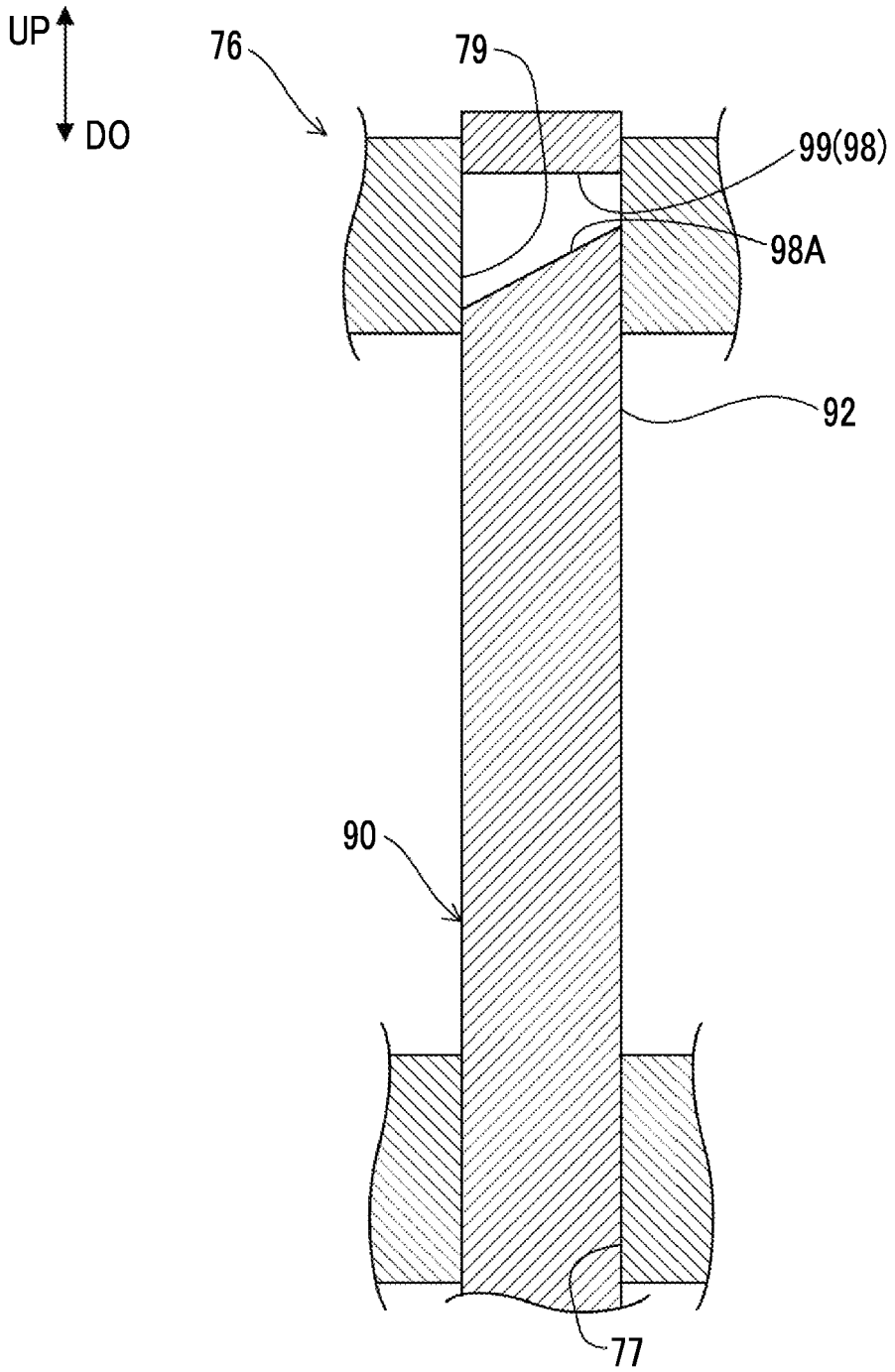
FIG. 19 is a sectional view taken along line 19X-19X of FIG. 18.

As shown in FIG. 11, the second blowing unit 82 is a configuration unit that blows the air G1 to the recording medium P from a changing region R2. The changing region R2 herein refers to a region of an opening that is a part of the blowing port unit 76 and that is surrounded by a two-dot chain line in FIG. 11. In addition, as shown in FIG. 11, the position of the region R2 in the up-down direction (the position of an opening positioned between the blade plates 78A in the up-down direction) changes in response to the vertical movement of the moving member 90. Further, the area (blowing area) of the region R2 of the present exemplary embodiment changes in some cases in response to the movement of the moving member 90. Specifically, as shown in FIGS. 18 and 19, the area (blowing area) of the region R2 shrinks as a second blowing port 98 (details to be described later) configuring the changing region R2 that changes in response to the lifting of the moving member 90 is closed with a closing unit 79 to be described later. On the other hand, the area (blowing area) of the region R2 increases as the second blowing port 98 closed with the closing unit 79 is exposed in response to the lowering of the moving member 90. Herein, in the second blowing unit 82, with the passage of time, the position of the region R2 changes up and down, or the area of the region R2 shrinks or expands. That is, the moving member 90 moves up and down while maintaining a constant speed. The position of the region R2 changes up and down in this moving state, or the area shrinks or expands. That is, in response to the vertical movement of the moving member 90, the area (blowing area) of the region R2 shrinks, and after then, the area (blowing area) of the region R2 increases in some cases. The region R2 changes in the same mode (in a print job). In addition, for example, it is preferable for the moving member 90 not to stop the movement while moving up and down, but may stop temporarily.

Figure 7:
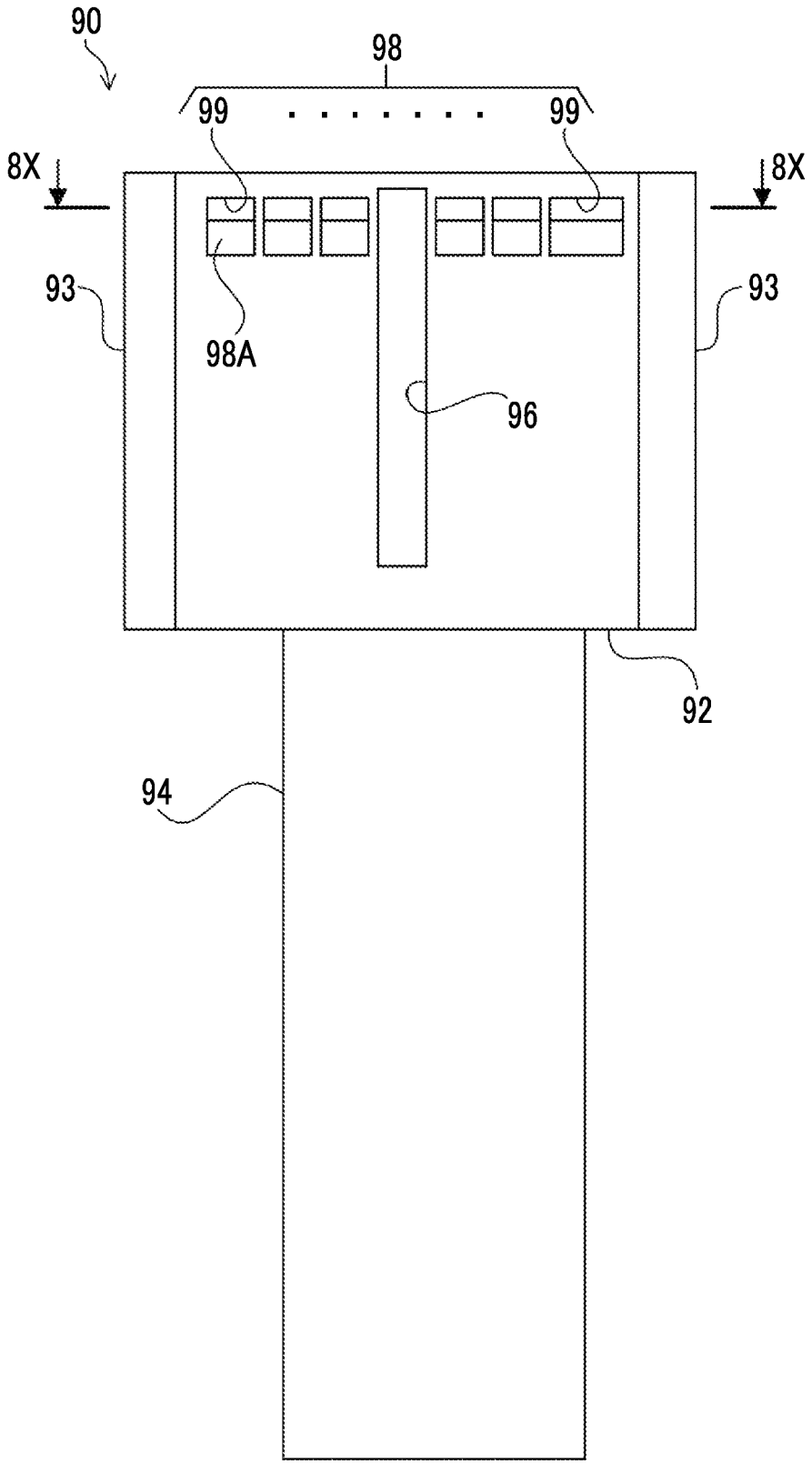
FIG. 7 is a front view of a moving member used in the feeding device according to the present exemplary embodiment.

The moving member 90 configures the blowing port unit 76 and is configured to be movable in the up-down direction. Specifically, the moving member 90 is inserted into a through-hole 77 that is provided in a portion on a back side of a tip of the blowing port unit 76 and that penetrates in the up-down direction and is movable (slidable) in the through-hole 77 in the up-down direction. As shown in FIG. 7, the moving member 90 includes a plate portion 92 and a shaft portion 94.

As shown in FIG. 7, the plate portion 92 has a first blowing port 96 and the second blowing port 98. Both of the first blowing port 96 and the second blowing port 98 are through-holes that penetrate the plate portion 92 in a thickness direction.

As shown in FIGS. 7 and 11, the first blowing port 96 extends in a moving direction of the moving member 90 (in other words, a stacking direction of the recording medium P). In other words, the first blowing port 96 extends from the upward direction to the downward direction. The first blowing port 96 is a long hole of which a longitudinal direction is the moving direction of the moving member 90. In addition, the length of the first blowing port 96 in an extending direction (longitudinal direction) is larger than the length of the region R1. Specifically, the length of the first blowing port 96 is set such that the entire region overlaps the region R1 at a first position (see FIG. 16 and FIGS. 18 to 20) where the moving member 90 has moved upward and the entire region overlaps the region R1 also at a second position (see FIG. 9 and FIGS. 11 to 13) where the moving member 90 has moved downward.

Figure 12:
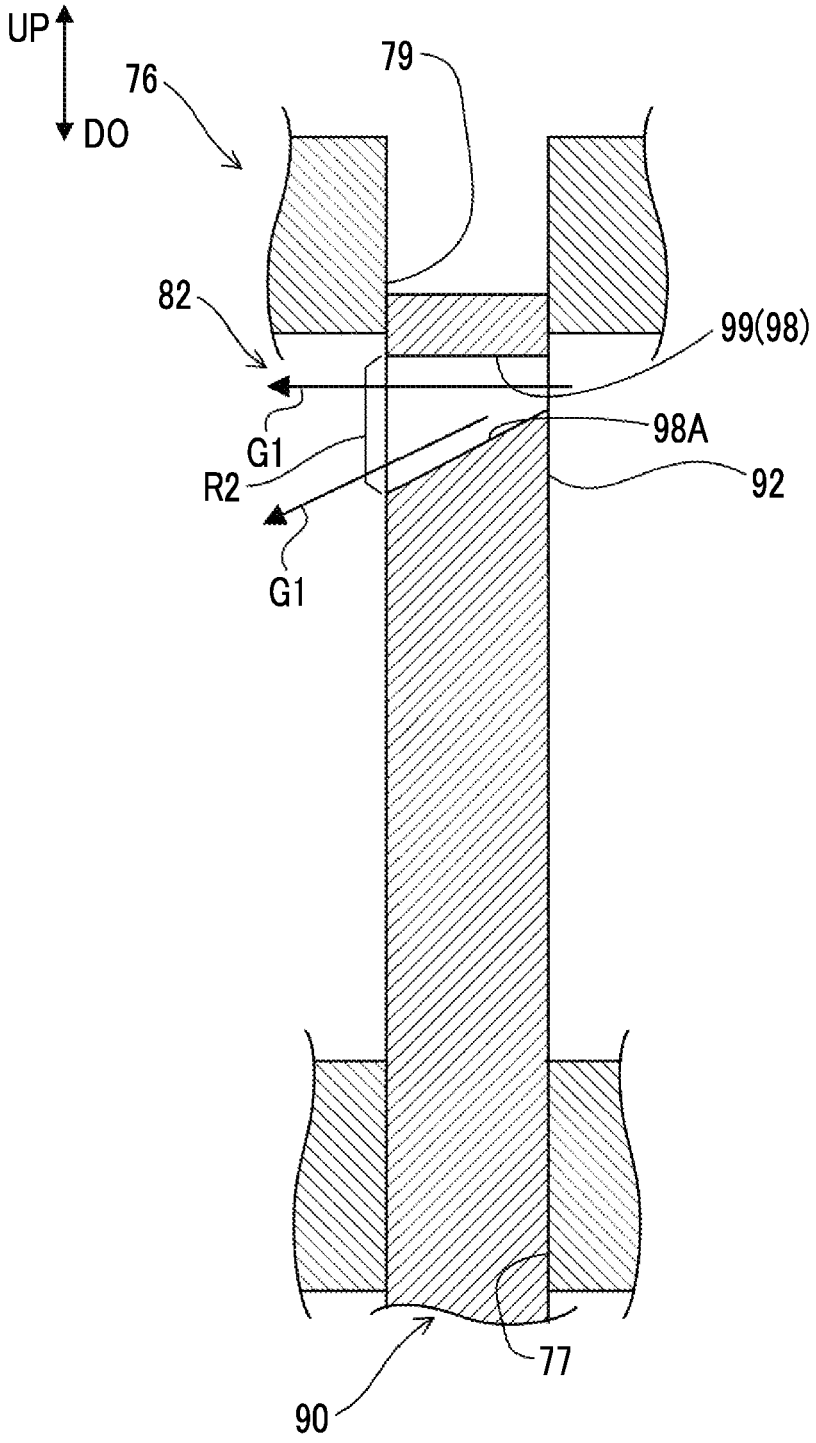
FIG. 12 is a sectional view taken along line 12X-12X of FIG. 11.

As shown in FIGS. 7 and 11, the second blowing port 98 extends in a direction intersecting a direction in which the first blowing port 96 extends with respect to the moving member 90. Specifically, the second blowing port 98 extends in a direction orthogonal to the direction in which the first blowing port 96 extends with respect to the moving member 90. In addition, the second blowing port 98 of the present exemplary embodiment is configured by a plurality of openings 99 disposed at intervals in the intersecting direction. For example, the plurality of (three) openings 99 are provided on each of both sides with the first blowing port 96 interposed therebetween. In addition, as shown in FIG. 12, the second blowing port 98 is inclined such that an opening length of a lower surface 98A becomes longer toward the blowing direction. In other words, the lower surface 98A of the second blowing port 98 is inclined obliquely downward with respect to the blowing direction.

In addition, both end portions of the plate portion 92 in the width direction are provided with slide units 93, respectively. The movement of the slide unit 93 in the up-down direction is guided by a guide unit 77A of the through-hole 77. That is, the movement of the moving member 90 in the up-down direction is guided by the guide unit 77A.

The shaft portion 94 is provided on a lower side of the plate portion 92. The shaft portion 94 is connected to a moving device 95 shown in FIG. 3. The moving device 95 moves the plate portion 92 in the up-down direction via the shaft portion 94. Specifically, the moving device 95 moves the moving member 90 to the first position by moving the moving member 90 upward and moves the moving member 90 to the second position by moving the moving member 90 downward. For example, a pushing member, such as an arm, and the like can be used as the moving device 95. In addition, a pulling member such as a wire may be used as the moving device 95. The moving device 95 is not limited to the configuration, and various configurations can be used.

In addition, as shown in FIG. 19, the blowing unit 31 has the closing unit 79 that closes the second blowing port 98 in response to the movement of the moving member 90 in the up-down direction. Specifically, the closing unit 79 is provided at the blowing port unit 76 and closes the second blowing port 98 in response to an upward movement of the moving member 90. In a case where the moving member 90 is at the second position, the second blowing port 98 is closed with the closing unit 79 as shown in FIGS. 18 and 19. As shown in FIG. 19, the closing unit 79 is provided on the downstream side of the moving member 90 of the blowing port unit 76 in the blowing direction and on an upper portion side thereof.

In addition, as shown in FIG. 1, the blowing unit 31 is disposed between the blowing units 30 adjacent to each other in the feeding direction of the recording medium P. Then, the blowing unit 31 blows the air G1 to a central portion of the plurality of stacked recording media P, that is, both side end portions of the recording medium P.

The blowing unit 31 may blow air between the plurality of stacked recording media P, that is, to at least one side end portion side of the side end portion sides of the recording media P.

Figure 6:
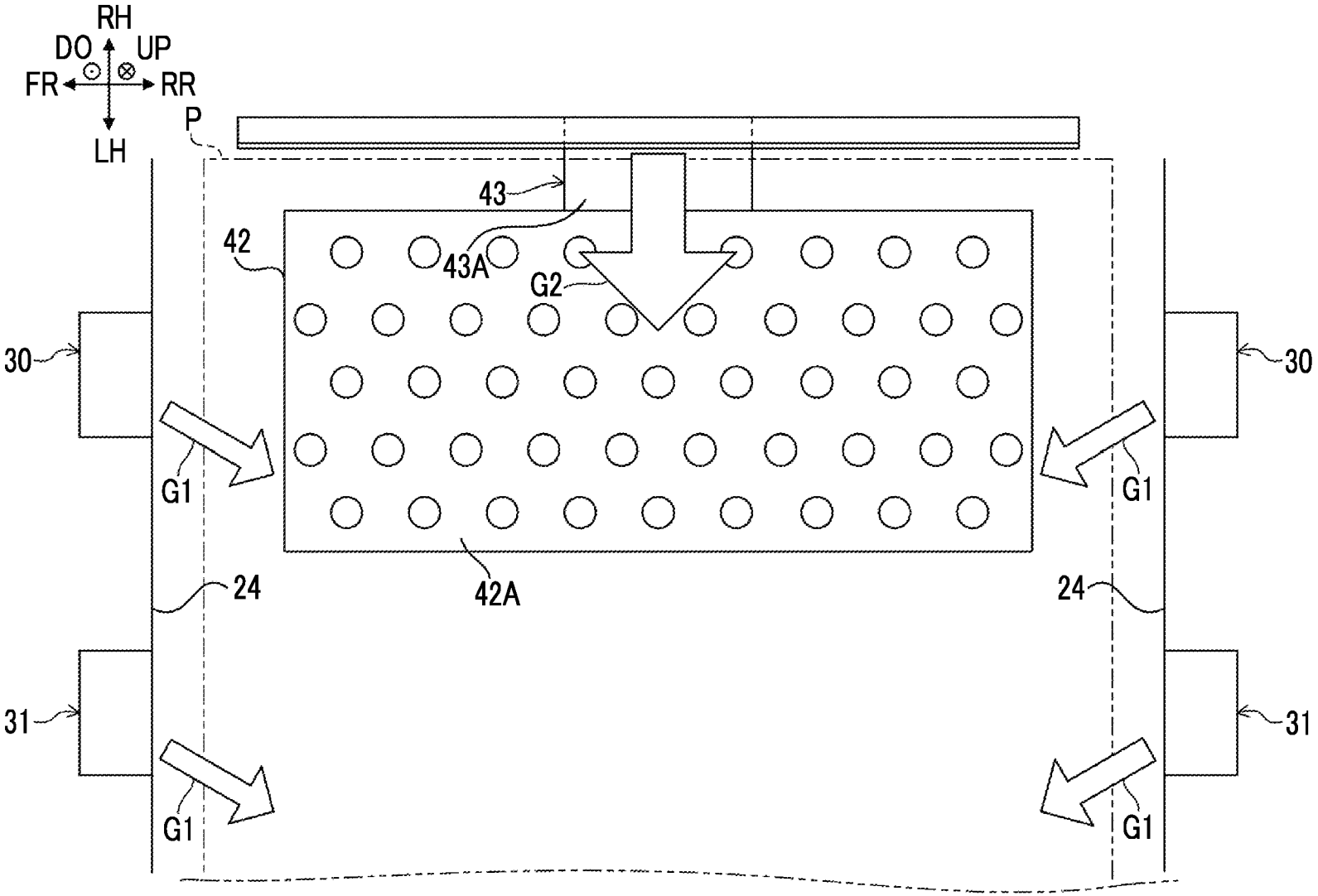
FIG. 6 is a view of the feeding device according to the present exemplary embodiment, which is viewed from a bottom surface side of the accommodating unit.

In the present exemplary embodiment, as shown in FIG. 6, the blowing direction of the air G1 of the blowing unit 30 and the blowing unit 31 is directed to an oblique direction from the downstream side toward the upstream side in the feeding direction. The present disclosure is not limited to this configuration. For example, the blowing direction of the air G1 of the blowing unit 30 and the blowing unit 31 may be a direction orthogonal to the feeding direction. In addition, the blowing port units 36 of the pair of blowing units 30 face each other in the present exemplary embodiment, but may be shifted away from each other in the feeding direction. Similarly, the blowing port units 76 of the pair of blowing units 31 face each other, but may be shifted away from each other in the feeding direction.

Feeding Unit 40

Figure 8:
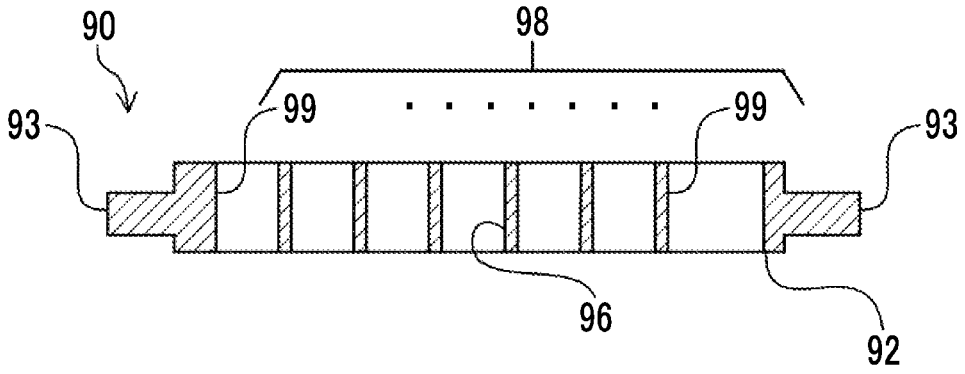
FIG. 8 is a sectional view taken along line 8X-8X of FIG. 7.

The feeding unit 40 shown in FIGS. 2, 4, and 5 is a configuration unit that makes the recording medium P floated by the blowing unit 30 and the blowing unit 31 stick thereto and that feeds the recording medium P. Specifically, as shown in FIG. 6, the feeding unit 40 makes the uppermost recording medium P (hereinafter, referred to as an uppermost medium P1), among the recording media P floated by the blowing unit 30 and the blowing unit 31, stick thereto and feeds the uppermost recording medium P1 to the downstream side in the feeding direction (specifically, the rightward direction) as shown in FIG. 8. More specifically, as shown in FIG. 2, the feeding unit 40 has a sticking body 42 and a moving mechanism 44.

The sticking body 42 is a configuration body that makes the uppermost medium P1 stick to a lower surface 42A through suction. Specifically, on a trailing end portion side of a leading end portion of the uppermost medium P1 positioned at the feeding height, the sticking body 42 makes the uppermost medium P1 stick thereto. An overhanging portion 43 that overhangs to the downstream side in the feeding direction (specifically, the rightward direction) is formed at the sticking body 42. As the uppermost medium P1 sticks to the lower surface 42A of the sticking body 42, the leading end portion of the uppermost medium P1 is pushed against a lower surface 43A of the overhanging portion 43. The lower surface 42A of the sticking body 42 is an example of a sticking surface.

The moving mechanism 44 is a mechanism that moves the sticking body 42 in the feeding direction with respect to a device body 12A of the feeding device 12. Specifically, the moving mechanism 44 is a mechanism that moves the sticking body 42 in the right-left direction (that is, a downstream direction and an upstream direction in the feeding direction), between a suction position (a position shown in FIGS. 2 and 4) and a delivery position (a position shown in FIG. 5).

Specifically, the moving mechanism 44 is configured, for example, by using a known mechanism such as a motor, a gear, a rack, a pinion, and a belt drive. The moving mechanism 44 is not limited to a certain mechanism, and various configurations can be used.

In the feeding unit 40, the sticking body 42 makes the uppermost medium P1 stick to the lower surface 42A through suction at the suction position (the position shown in FIGS. 2 and 4), and the sticking body 42 is moved to the delivery position (the position shown in FIG. 5) by the moving mechanism 44. Then, at the delivery position, the recording medium P is delivered from the sticking body 42 to a pair of feeding rollers 46, and the pair of feeding rollers 46 feed the recording medium P toward the image forming unit 16.

The pair of feeding rollers 46 are feeding members that feed the recording medium P toward the image forming unit 16. The pair of feeding rollers 46 are disposed on the downstream side in the feeding direction with respect to the sticking body 42 (specifically, the delivery position described above) to come into contact with each other in the up-down direction. The feeding members are not limited to the pair of feeding rollers 46. The feeding members may be, for example, feeding members such as annular belts and drums, and it is possible to use various feeding members.

The feeding unit 40 is not limited to the configuration. For example, the feeding unit 40 may be configured to use a feeding member such as a belt, instead of the sticking body 42. In the configuration in which the annular belt is used, for example, a suction unit that makes the recording medium P stick to an outer peripheral surface of the belt through suction can be configured to be provided at an inner periphery of the belt. In a case of such an annular belt, the stuck recording medium P can be fed to the pair of feeding rollers 46 through circumferential motion of the belt. That is, in a case of the annular belt, the recording medium P can be fed to the pair of feeding rollers 46 even in a state where the belt is fixed to the device body 12A in the right-left direction.

Separating Unit 50

The separating unit 50 shown in FIGS. 4 and 5 is a configuration unit that blows air G2 to the recording medium P (hereinafter, referred to as the next medium P2) positioned immediately below the uppermost medium P1 stuck to the feeding unit 40 (specifically, the sticking body 42) and that separates the next medium P2 from the uppermost medium P1. The next medium P2 is the recording medium P that is fed next to the uppermost medium P1 and is the recording medium P disposed adjacently below the uppermost medium P1. More specifically, the separating unit 50 has, for example, a blowing device 52, a flow pipe 54, and a nozzle 56 as shown in FIG. 4.

The blowing device 52 is a device that blows the air G2 to the flow pipe 54. Specifically, for example, an air compressor that blows compressed air to the flow pipe 54 or the like is used as the blowing device 52. The blowing device 52 is not limited to the air compressor, and other blowing devices may be used.

The flow pipe 54 configures a passage through which the air G2 sent from the blowing device 52 passes.

A plurality of nozzles 56 may be provided along the width direction (that is, the front-rear direction) of the recording medium P with respect to the flow pipe 54. In the present exemplary embodiment, as shown in FIG. 6, the nozzles 56 are provided at the central portion of the recording medium P in the width direction. The nozzles 56 extend from the flow pipe 54 to a sticking body 42 (specifically, the overhanging portion 43) side (that is, an obliquely upper left side). The nozzles 56 have a function of leading the air G2 blown from the blowing device 52 through the flow pipe 54 to an upper side (obliquely upper left side).

In the separating unit 50, in a state where the sticking body 42 is positioned at the suction position (the position shown in FIGS. 2 and 4), air is jetted from the nozzle 56 toward the overhanging portion 43 from the downstream side in the feeding direction. The jetted air G2 hits the overhanging portion 43. The hit air is blown between the uppermost medium P1 and the next medium P2. Then, the air G2 that has hit the overhanging portion 43 is guided by the lower surface 43A and is blown between the uppermost medium P1 and the next medium P2. Specifically, the blown air G2 passes between the uppermost medium P1 and the next medium P2 from the downstream side to the upstream side in the feeding direction. Accordingly, the next medium P2 is separated from the uppermost medium P1.

As described above, since the air G2 jetted from the nozzle 56 is blown between the uppermost medium P1 and the next medium P2 through the overhanging portion 43, the overhanging portion 43 may be understood as one element of the separating unit 50. The separating unit 50 may be configured to blow air directly between the uppermost medium P1 and the next medium P2 without passing through the overhanging portion 43.

Restricting Unit 59

The restricting unit 59 shown in FIG. 4 is a configuration unit that restricts the movement of the next medium P2 to the downstream side in the feeding direction. Specifically, the restricting unit 59 is configured by a restricting wall disposed between the accommodating unit 20 and the pair of feeding rollers 46 (specifically, the feeding roller 46 disposed on the lower side) in side view. The restricting unit 59 is formed in a plate shape extending in the up-down direction in side view.

The restricting unit 59 lowers the next medium P2 from the uppermost medium P1 by coming into contact with the next medium P2 fed to the downstream side in the feeding direction together with the uppermost medium P1 in response to the movement of the sticking body 42 to the delivery position and restricts the movement of the next medium P2 to the downstream side in the feeding direction. The restricting unit 59 is not limited to the configuration, and other restricting means may be used.

FIG. 21 is a block diagram showing a hardware configuration of the feeding device 12. The feeding device 12 has the control device 100, and the lifting and lowering unit 29, the blowing unit 30, the blowing unit 31, the feeding unit 40, the separating unit 50, and the control device 100 are connected to each other in a manner that enables communication via a bus.

Control Device 100

As described in FIG. 21, the control device 100 is configured to include a central processing unit (CPU: processor) 101, a read only memory (ROM) 102, a random access memory (RAM) 103, and a storage 104.

The CPU 101 is a central arithmetic processing unit, executes various types of programs, or controls each unit. That is, the CPU 101 reads a program from the ROM 102 or the storage 104 and executes the program with the RAM 103 as a work area. The CPU 101 performs control of each configuration and various types of arithmetic processing in accordance with the program stored in the ROM 102 or the storage 104.

The ROM 102 stores various types of programs and various types of data. The RAM 103 temporarily stores a program or data as a work area. The storage 104 is configured by a hard disk drive (HDD) or a solid state drive (SSD) and stores various types of programs including an operating system and various types of data.

The control device 100 of the present exemplary embodiment has a first control mode and a second control mode and is configured to switch between the first control mode and the second control mode depending on feeding conditions of the recording medium P.

Figure 17:
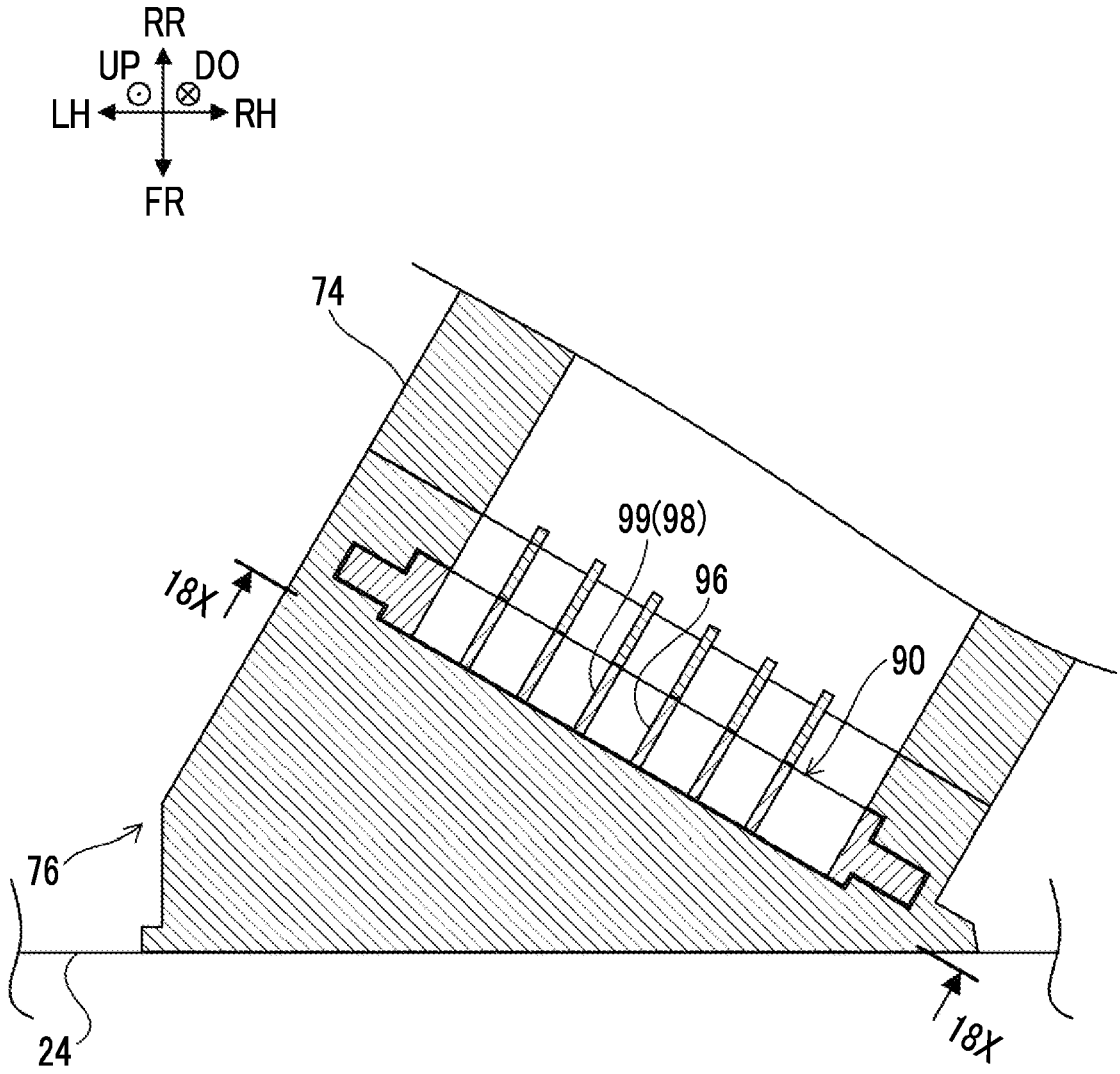
FIG. 17 is a sectional view taken along line 17X-17X of FIG. 16.
Figure 20:
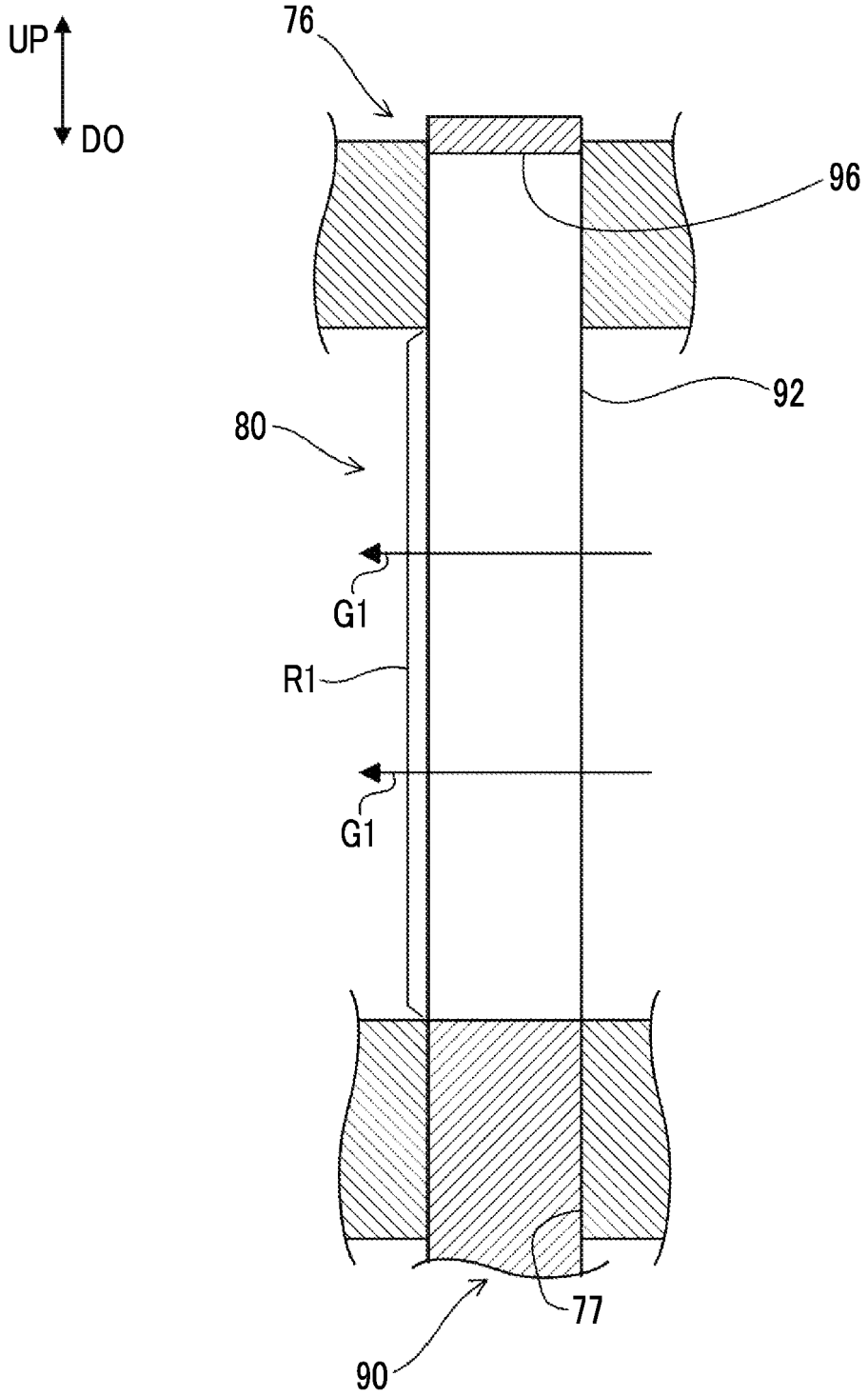
FIG. 20 is a sectional view taken along line 20X-20X of FIG. 18.

The first control mode of the control device 100 is a mode in which air blowing from the second blowing unit 82 to the recording medium P is stopped and air blowing from the first blowing unit 80 to the recording medium P is performed. In the first control mode, the control device 100 moves the moving member 90 to the first position shown in FIGS. 18 to 20. In a case where the moving member 90 moves to the first position, the second blowing port 98 configuring the second blowing unit 82 is closed with the closing unit 79. Accordingly, air blowing from the second blowing unit 82 (second blowing port 98) is prevented by the closing unit 79. On the other hand, in the first blowing port 96 configuring the first blowing unit 80, a blowing region of the air G1 does not change since the entire defined region R1 is positioned on an inner side of the first blowing port 96 (in an opening region of the first blowing port 96) as shown in FIG. 20 even in a case where the moving member 90 moves to the first position. As the air G1 is blown from the blowers 72 via the first blowing port 96 in this state, the air G1 can be blown from the first blowing unit 80 to the recording medium P (see FIG. 20) in a state where air blowing from the second blowing unit 82 is stopped (see FIGS. 17 and 19).

Figure 13:
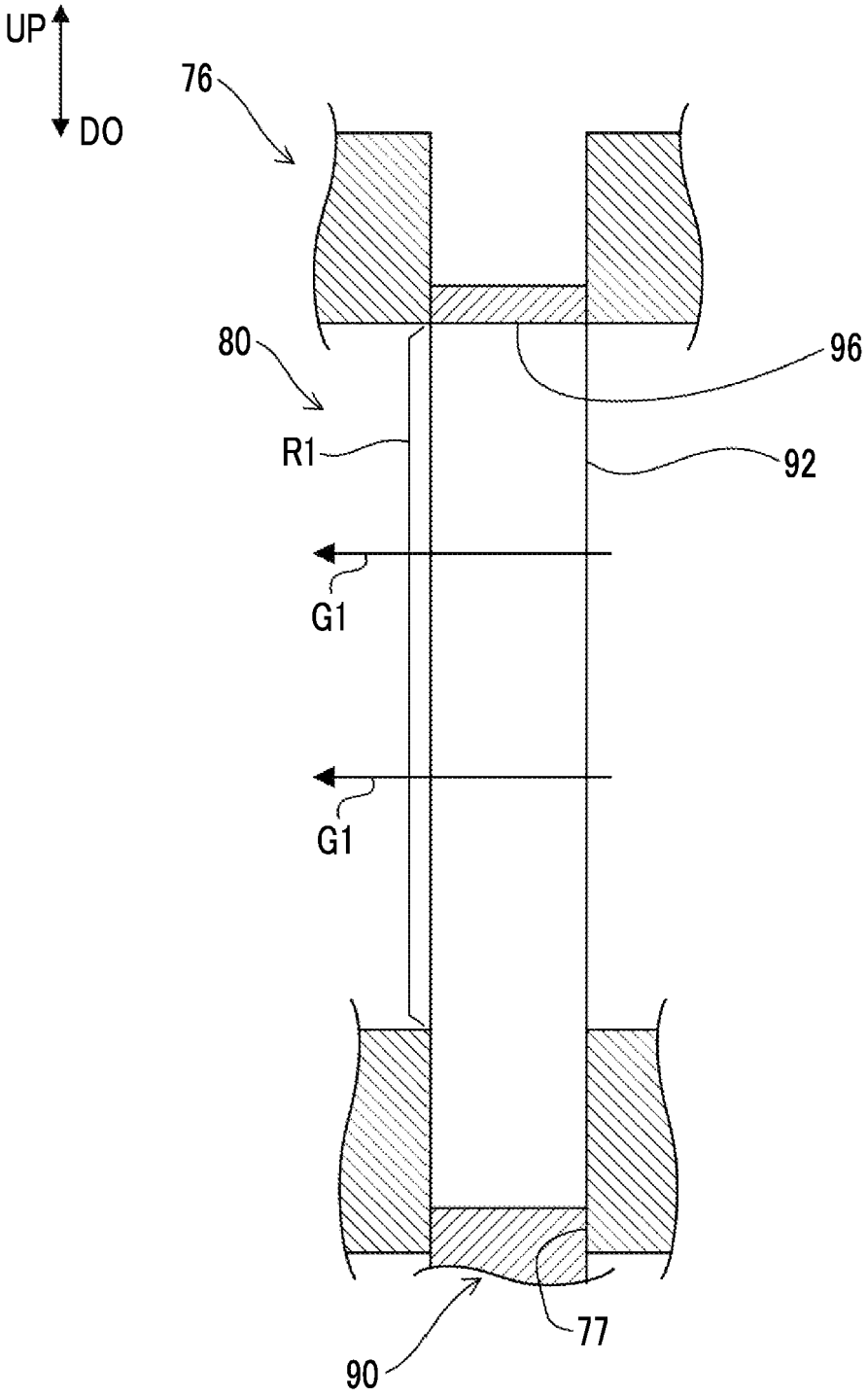
FIG. 13 is a sectional view taken along line 13X-13X of FIG. 11.
Figure 14:
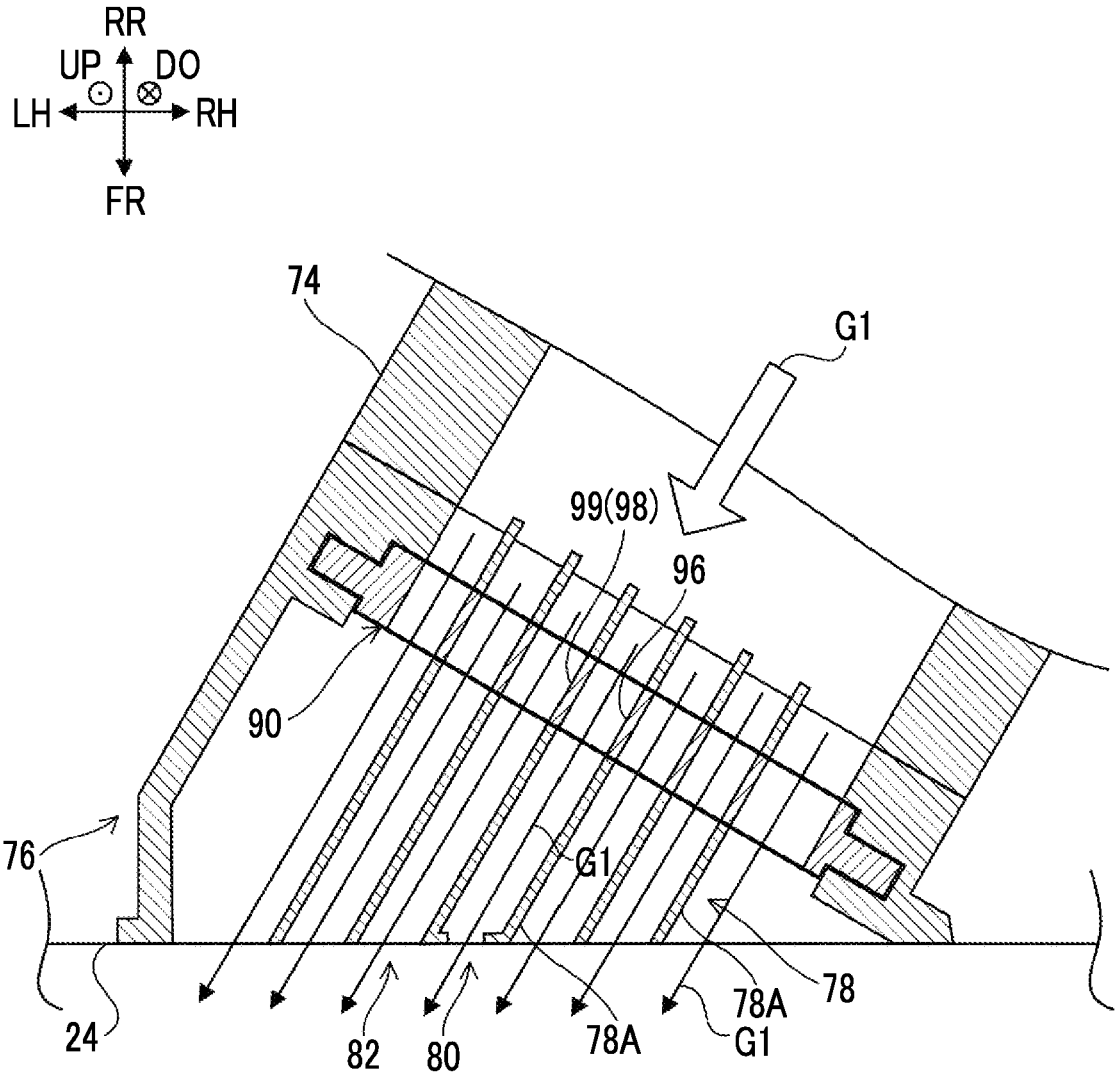
FIG. 14 is a view showing a state where air is blown from the blowing port of the blowing unit in the sectional view shown in FIG. 10.
Figure 15:
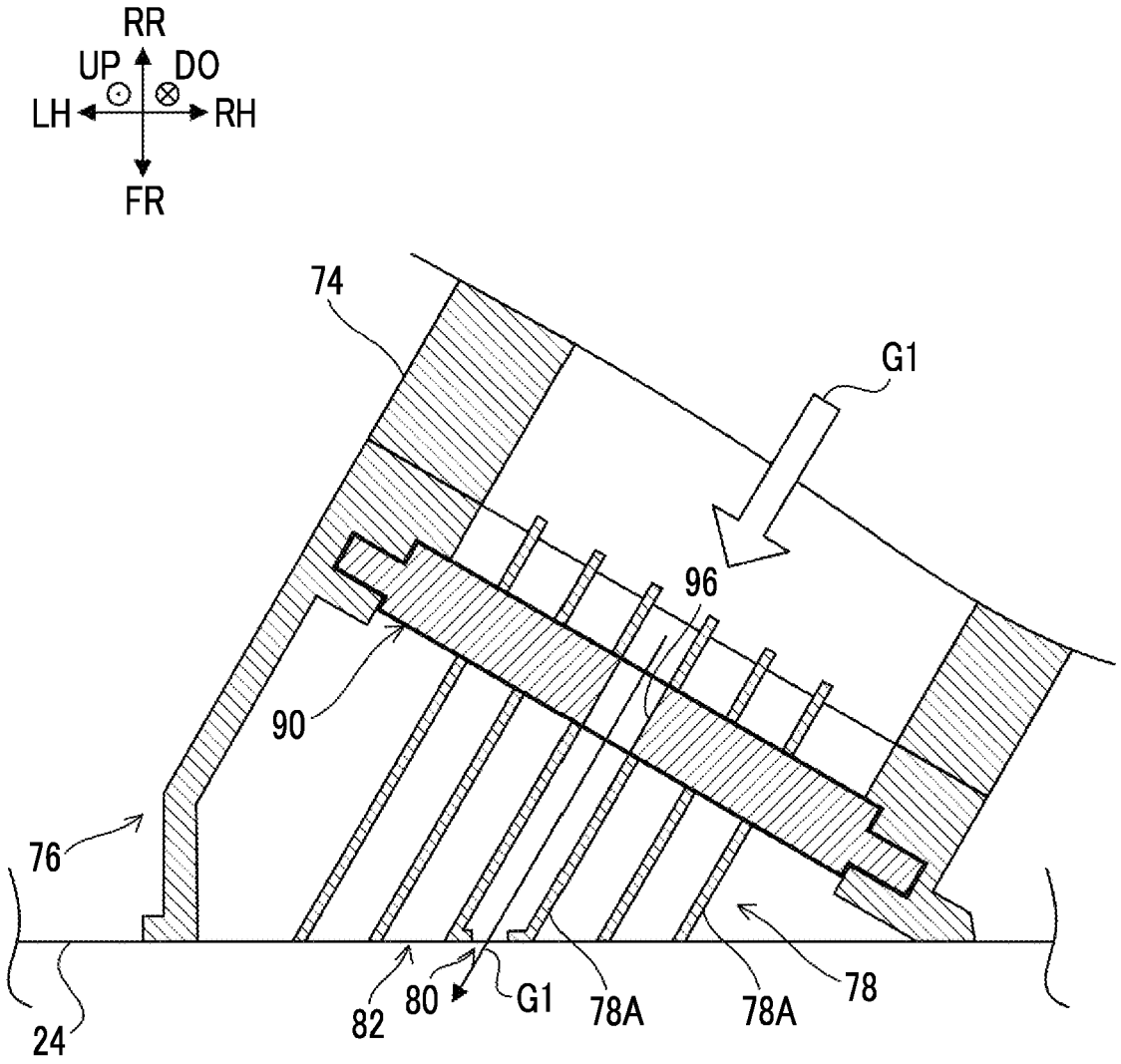
FIG. 15 is a sectional view taken along line 15X-15X of FIG. 9.
Figure 16:
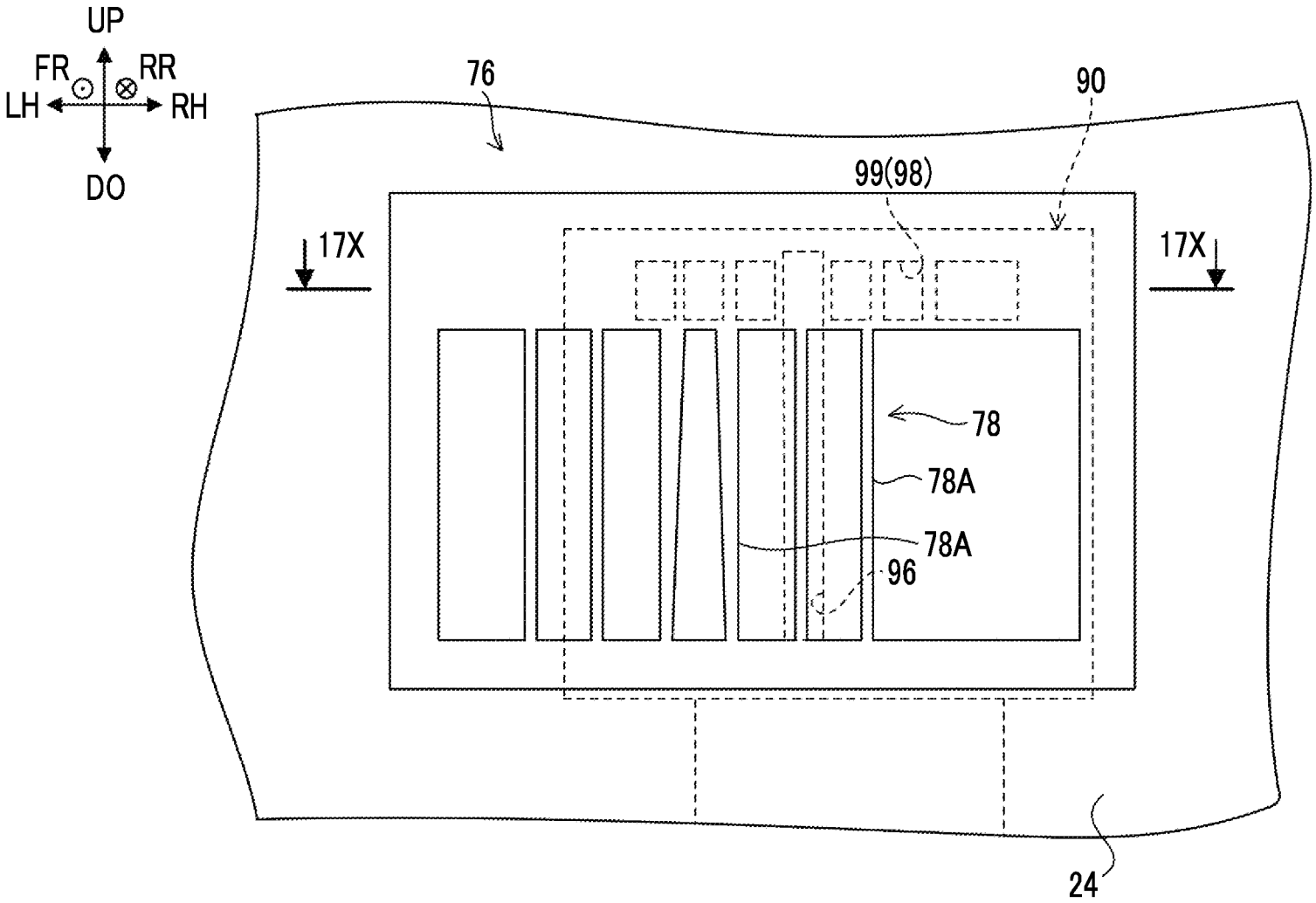
FIG. 16 is a view of the blowing port of the blowing unit used in the feeding device according to the present exemplary embodiment, which is viewed from the inner surface side of the side wall, and shows the moving member positioned at a first position.

In addition, the second control mode of the control device 100 is a mode in which the first blowing unit 80 and the second blowing unit 82 simultaneously perform air blowing to the recording medium P. In the second control mode, the control device 100 moves the moving member 90 to the second position shown in FIGS. 11 to 13. Herein, the entire defined region R1 is positioned on the inner side of the first blowing port 96 (in the opening region of the first blowing port 96) as shown in FIG. 13 even in a case where the moving member 90 moves to the second position. On the other hand, in a case where the moving member 90 moves to the second position, the second blowing port 98 is opened as shown in FIG. 12. As the air G1 is blown from the blowers 72 via the first blowing port 96 and the second blowing port 98 in this state, air blowing from the first blowing unit 80 and the second blowing unit 82 to the recording medium P can be simultaneously performed (see FIGS. 14 and 15).

In addition, the feeding conditions of the recording medium P include at least one of the type or the environmental humidity of the recording medium P. Herein, examples of the type of the recording medium P include a paper type and a dimension. The type of the recording medium P may be acquired from information input by a user. Alternatively, the feeding device 12 is provided with a sensor, and the type of the recording medium may be acquired from information from the sensor.

In addition, the control device 100 of the present exemplary embodiment is set such that air blowing is performed in the first control mode in a case where the recording medium P is thin paper, and air blowing is performed in the second control mode in a case where the recording medium P is thick paper. Specifically, the control device 100 is set such that air blowing is performed in the first control mode in a case where the recording medium P is thin paper and has an environmental humidity RH of less than 55%, and air blowing is performed in the second control mode in a case where the recording medium P is thick paper and has an environmental humidity RH of 55% or more. The present disclosure is not limited to this configuration, and in a case where the feeding conditions of the recording medium P include only the type of the recording medium P, a control mode may be switched depending on whether the recording medium P is thin paper or the recording medium P is thick paper. In addition, in a case where the feeding conditions of the recording medium P include only the environmental humidity, setting may be made such that air blowing is performed in the second control mode in a case where the environmental humidity RH is 55% or more, and air blowing is performed in the first control mode in a case where the environmental humidity RH is less than 55%.

In the present exemplary embodiment, an air blowing control program that controls a state where air is blown to the recording medium P by the blowing unit 31 depending on the feeding conditions of the recording medium P is stored in the ROM 102 or the storage 104. Through the program, the control device 100 has a function of switching between the first control mode and the second control mode depending on the feeding conditions of the recording medium P.

Workings According to Present Exemplary Embodiment

Next, workings according to the present exemplary embodiment will be described.

In the feeding device 12, air is blown between the plurality of stacked recording media P from the blowing unit 30 and the blowing unit 31, and the recording media P are floated. Next, the feeding unit 40 makes the uppermost medium P1 floated by the blowing unit 30 and the blowing unit 31 stick thereto. Then, the separating unit 50 blows the air G2 obliquely downward from the downstream side to the upstream side in the feeding direction to a front surface side of the next medium P2 positioned immediately below the uppermost medium P1 stuck to the feeding unit 40 and separates the next medium P2 from the uppermost medium P1. Specifically, the air G2 blown from the nozzle 56 to the front surface side of the next medium P2 passes between the next medium P2 and the uppermost medium P1 and separates the next medium P2 from the uppermost medium P1. After then, the feeding unit 40 is moved to the delivery position and feeds the uppermost medium P1.

In the feeding device 12 of the present exemplary embodiment, the control device 100 has the second control mode in which air blowing from the first blowing unit 80 and the second blowing unit 82 to the recording medium P is simultaneously performed. For this reason, the feeding device 12 may stabilize the posture of the floating uppermost medium P1 by blowing air in the second control mode compared to a case where air is blown to the side end portion of the recording medium P only from the changing region R2 for floating the recording medium P. Accordingly, a transport failure of the recording medium P may be prevented.

In addition, since the changing region R2 of the second blowing unit 82 changes in the up-down direction in the feeding device 12 of the present exemplary embodiment, compared to a case where the changing region R2 changes in the horizontal direction, the air G1 is likely to flow between the floating uppermost medium P1 and the next medium P2, and close contact between the uppermost medium P1 and the next medium P2 may be weakened. Accordingly, double-feeding of the recording media P may be prevented.

In addition, in the feeding device 12 of the present exemplary embodiment, the control device 100 stops air blowing from the second blowing unit 82 and switches between the first control mode in which air blowing from the first blowing unit 80 to the recording medium P is performed and the second control mode depending on the feeding conditions of the recording medium P. For this reason, in the feeding device 12, both of stabilizing the posture of the floating recording medium P and weakening close contact between the floating uppermost medium P1 and the next medium P2 may be achieved compared to a case where the control device 100 does not switch between the first control mode and the second control mode depending on the feeding conditions of the recording medium P. That is, the transport failure of the recording medium P and the double-feeding of the recording media P may be prevented.

In addition, in the feeding device 12 of the present exemplary embodiment, the control device 100 includes at least one of the type (a paper type or a dimension) or environmental humidity of the recording medium P as the feeding conditions of the recording medium P. For this reason, in the feeding device 12, both of stabilizing the posture of the floating recording medium P and weakening close contact between the floating uppermost medium P1 and the next medium P2 may be achieved compared to a case where the feeding conditions of the recording medium P do not include the type and the environmental humidity of the recording medium P.

In addition, in the feeding device 12 of the present exemplary embodiment, in a case where the paper type of the recording medium P is thin paper, the control device 100 performs air blowing in the first control mode. Since the thin paper has a high medium floating sensitivity in response to blowing of the air G1 compared to thick paper (that is, the thin paper is likely to float compared to the thick paper), there is a tendency in which a stable medium floating posture is likely to be lost through blowing of the air G1 from the changing region R2. For this reason, in the feeding device 12, in a case where the paper type of the recording medium P is thin paper, air blowing from the second blowing unit 82 (changing region R2) is stopped, and only air blowing from the first blowing unit 80 (defined region R1) is performed. Accordingly, in the feeding device 12, compared to a configuration where air blowing is performed in the second control mode in a case where the recording medium P is the thin paper, the posture of top floating thin paper may be stabilized.

In addition, in the feeding device 12 of the present exemplary embodiment, in a case where the paper type of the recording medium P is thick paper, the control device 100 performs air blowing in the second control mode. The thick paper has a low medium floating sensitivity in response to blowing of the air G1 compared to thin paper (that is, the thick paper is unlikely to float compared to the thin paper). For this reason, in the feeding device 12, air blowing from both of the first blowing unit 80 and the second blowing unit 82 is performed in a case where the paper type of the recording medium P is the thick paper. Accordingly, in the feeding device 12, compared to a configuration where air blowing is performed in the first control mode in a case where the recording medium P is the thick paper, both of stabilizing the posture of the floating thick paper and weakening close contact between the top floating thick paper and second thick paper from the top may be achieved.

In addition, in the feeding device 12 of the present exemplary embodiment, since the blowing unit 31 has the blowing pipe 74 and the first blowing port 96 and the second blowing port 98 that configure the blowing port unit 76, which is the outlet unit of the blowing pipe 74, the posture of the floating recording medium P is easily stabilized compared to a case where the first blowing port 96 and the second blowing port 98 configure outlet units of respective blowing pipes.

In addition, in the feeding device 12 of the present exemplary embodiment, the blowing unit 31 has the moving member 90 that configures the blowing port unit 76 and that is movable in the up-down direction, and the moving member 90 is provided with the first blowing port 96 and the second blowing port 98. For this reason, in the feeding device 12, close contact between the floating uppermost medium P1 and the next medium P2 may be weakened compared to a case where the second blowing port 98 moves in the horizontal direction together with the moving member 90.

In addition, in the feeding device 12 of the present exemplary embodiment, since the first blowing port 96 extends from the upward direction to the downward direction and the second blowing port 98 extends in the direction intersecting the direction in which the first blowing port 96 extends with respect to the moving member 90, the posture of the floating recording medium P is easily stabilized compared to a case where the first blowing port 96 and the second blowing port 98 extend in the same direction.

In addition, in the feeding device 12 of the present exemplary embodiment, since the second blowing port 98 is configured by the plurality of openings 99 disposed at intervals in the direction intersecting the first blowing port 96, a wind speed per opening increases compared to a case where the second blowing port 98 is configured by one opening extending in the intersecting direction.

In addition, in the feeding device 12 of the present exemplary embodiment, since the blowing unit 31 has the closing unit 79 that closes the second blowing port 98 in response to the movement of the moving member 90 in the up-down direction, the configuration of the device is simplified compared to a case where the second blowing port 98 is closed as the closing unit 79 moves.

In addition, since the feeding device 12 is used in the image forming apparatus 10 of the present exemplary embodiment, a media jam caused by the double-feeding of the recording media P may be prevented compared to a case where a feeding device that blows the air G1 to the side end portions of the recording media P only from the changing region R2 for floating the recording media P is used.

Modification Example

Figure 22:
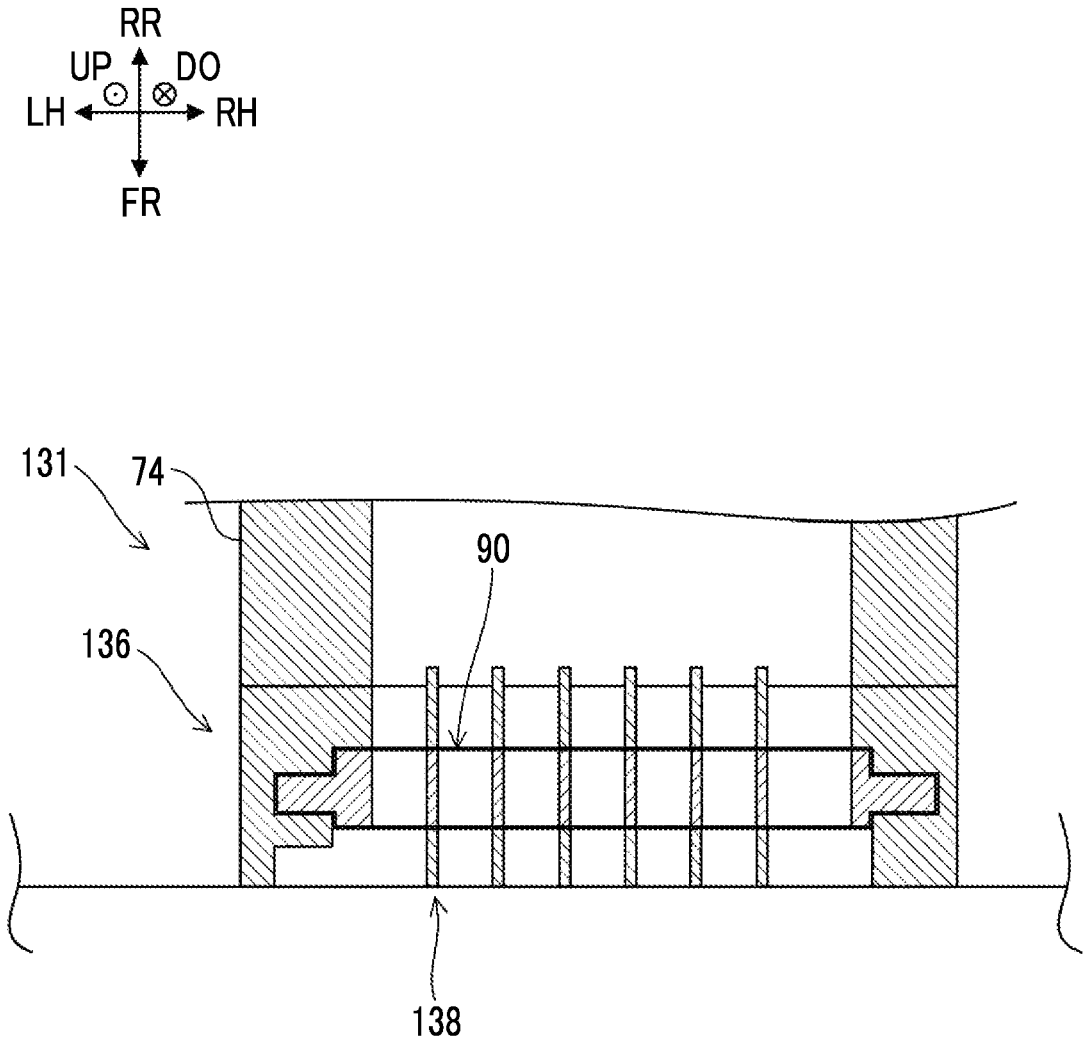
FIG. 22 is a sectional view showing a modification example of the blowing port of the blowing unit used in the feeding device according to the present exemplary embodiment (is a sectional view corresponding to FIG. 10).

Although the air G1 is blown toward an opposite side to the feeding direction of the recording medium P due to the louver 78 provided at the blowing port unit 76 as shown in FIG. 6 in the blowing unit 31 of the exemplary embodiment described above, the present disclosure is not limited thereto. As in a blowing port unit 136 of a blowing unit 131 shown in FIG. 22, the air G1 may be blown in the direction orthogonal to the feeding direction of the recording medium P due to a louver 138. Further, the louver 138 may not be provided.

Although the openings 99 configuring the second blowing port 98 are provided on both sides respectively with the first blowing port 96 interposed therebetween in the feeding device 12 of the exemplary embodiment described above, the present disclosure is not limited thereto. For example, the second blowing port 98 may be configured to be provided on only one side of the first blowing port 96. Further, the second blowing port 98 may extend in the direction intersecting the first blowing port 96 and intersect the first blowing port 96. As the first blowing port 96 and the second blowing port 98 intersect each other, the width of the plate portion 92 of the moving member 90 may be decreased and the size of the moving member 90 may be made small compared to a case where the first blowing port 96 and the second blowing port 98 are separated from each other.

Although the recording medium P is floated by the plurality of blowing units 30 and one blowing unit 31 in the feeding device 12 of the exemplary embodiment described above, the present disclosure is not limited to this configuration. For example, the recording medium P may be floated by operating only one blowing unit 31 depending on the feeding conditions of the recording medium P, or the recording medium P may be floated by operating the blowing unit 30 on the downstream side in the feeding direction and the blowing unit 31.

Although the feeding device 12 has the plurality of blowing units 30 and one blowing unit 31 in the exemplary embodiment described above, the present disclosure is not limited thereto. For example, the feeding device 12 may be configured to have only one or a plurality of blowing units 31. In a case where the feeding device 12 has the plurality of blowing units 31 instead of the plurality of blowing units 30, control modes of the respective blowing units 31 may be switched depending on a position with respect to the recording medium P.

The present disclosure is not limited to the exemplary embodiment, and various modifications, changes, and improvements can be made without departing from the gist thereof. For example, the plurality of modification examples described above may be configured in combination as appropriate. For example, the first blowing unit 80 and the second blowing unit 82 may be provided separately from each other.

Supplementary Note (((1)))

A feeding device comprising:

a blowing unit that floats a plurality of stacked media by blowing air to side end portions of the media and that has a first blowing unit which blows the air from a defined region to the media and a second blowing unit which blows the air from a changing region to the media;

a feeding unit that feeds the floating media; and a control unit that has a control mode in which the first blowing unit and the second blowing unit simultaneously perform air blowing on the media.

(((2)))

The feeding device according to (((1))), wherein the changing region of the second blowing unit changes in an up-down direction.

(((3)))

The feeding device according to (((1))) or (((2))), wherein the control unit has a first control mode in which air blowing from the second blowing unit is stopped and air blowing from the first blowing unit to the medium is performed and switches between the first control mode and a second control mode, which is the control mode, depending on a feeding condition of the medium.

(((4)))

The feeding device according to (((3))), wherein the feeding condition of the medium includes at least one of a type or an environmental humidity of the medium.

(((5)))

The feeding device according to (((4))), wherein in a case where the medium is thin paper, the control unit performs air blowing in the first control mode.

(((6)))

The feeding device according to (((4))), wherein in a case where the medium is thick paper, the control unit performs air blowing in the second control mode.

(((7)))

The feeding device according to any one of (((1))) to (((6))), wherein the blowing unit has a blowing pipe of the air, a first blowing port, which is the first blowing unit, and a second blowing port, which is the second blowing unit, both of which configure an outlet unit of the blowing pipe.

(((8)))

The feeding device according to (((7))), wherein the blowing unit has a moving member that configures the outlet unit of the blowing pipe and that is movable in an up-down direction, and the first blowing port and the second blowing port are provided in the moving member.

(((9)))

The feeding device according to (((8))), wherein the first blowing port extends from an upward direction to a downward direction, and the second blowing port extends in a direction intersecting a direction in which the first blowing port extends with respect to the moving member.

(((10)))

The feeding device according to (((9))), wherein the second blowing port intersects the first blowing port.

(((11)))

The feeding device according to (((9))), wherein the second blowing port is configured by a plurality of openings disposed at an interval in the intersecting direction.

(((12)))

The feeding device according to any one of (((9))) to (((11))), wherein the blowing unit has a closing unit that closes the second blowing port in response to a movement of the moving member in an up-down direction.

(((13)))

A feeding device comprising:

a blowing unit that floats a plurality of stacked media by blowing air to side end portions of the media and that has a first blowing port which blows the air from a defined region to the media and a second blowing port which blows the air from a changing region to the media;

a feeding unit that feeds the floating media; and a control unit that has a control mode in which the first blowing port and the second blowing port simultaneously perform air blowing on the media.

(((14)))

The feeding device according to (((13))), wherein the blowing unit has a blowing pipe of the air, and an outlet unit of the blowing pipe is configured by the first blowing port and the second blowing port.

(((15)))

The feeding device according to (((14))), wherein the blowing unit has a moving member that configures the outlet unit of the blowing pipe and that is movable in an up-down direction, and the first blowing port and the second blowing port are provided in the moving member.

(((16)))

An image forming apparatus comprising:

the feeding device according to any one of (((1))) to (((15))); and an image forming unit that forms an image on a medium fed from the feeding device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeding device comprising:

a blowing unit that floats a plurality of stacked media by blowing air to side end portions of the media and that has a first blowing unit which blows the air from a defined region to the media and a second blowing unit which blows the air from a changing region to the media;

a feeding unit that feeds the floating media; and a control unit that has a control mode in which the first blowing unit and the second blowing unit simultaneously perform air blowing on the media, wherein the blowing unit has a blowing pipe of the air, a first blowing port, which is the first blowing unit, and a second blowing port, which is the second blowing unit, both of which configure an outlet unit of the blowing pipe, wherein the blowing unit has a moving member that configures the outlet unit of the blowing pipe and that is movable in an up-down direction, and the first blowing port and the second blowing port are provided in the moving member.

2. The feeding device according to claim 1, wherein the changing region of the second blowing unit changes in an up-down direction.

3. The feeding device according to claim 1, wherein the control unit has a first control mode in which air blowing from the second blowing unit is stopped and air blowing from the first blowing unit to the medium is performed and switches between the first control mode and a second control mode, which is the control mode, depending on a feeding condition of the medium.

4. The feeding device according to claim 3, wherein the feeding condition of the medium includes at least one of a type or an environmental humidity of the medium.

5. The feeding device according to claim 4, wherein in a case where the medium is thin paper, the control unit performs air blowing in the first control mode.

6. The feeding device according to claim 4, wherein in a case where the medium is thick paper, the control unit performs air blowing in the first control mode.

7. The feeding device according to claim 1, wherein the first blowing port extends from an upward direction to a downward direction, and the second blowing port extends in a direction intersecting a direction in which the first blowing port extends with respect to the moving member.

8. The feeding device according to claim 7, wherein the second blowing port intersects the first blowing port.

9. The feeding device according to claim 7, wherein the second blowing port is configured by a plurality of openings disposed at an interval in the intersecting direction.

10. The feeding device according to claim 7, wherein the blowing unit has a closing unit that closes the second blowing port in response to a movement of the moving member in an up-down direction.

11. A feeding device comprising:

a blowing unit that floats a plurality of stacked media by blowing air to side end portions of the media and that has a first blowing port which blows the air from a defined region to the media and a second blowing port which blows the air from a changing region to the media;

a feeding unit that feeds the floating media; and a control unit that has a control mode in which the first blowing port and the second blowing port simultaneously perform air blowing on the media, wherein the blowing unit has a blowing pipe of the air, and an outlet unit of the blowing pipe is configured by the first blowing port and the second blowing port, wherein the blowing unit has a moving member that configures the outlet unit of the blowing pipe and that is movable in an up-down direction, and the first blowing port and the second blowing port are provided in the moving member.

12. An image forming apparatus comprising:

the feeding device according to claim 1; and an image forming unit that forms an image on a medium fed from the feeding device.

13. An image forming apparatus comprising:

the feeding device according to claim 2; and an image forming unit that forms an image on a medium fed from the feeding device.

14. An image forming apparatus comprising:

the feeding device according to claim 3; and an image forming unit that forms an image on a medium fed from the feeding device.

15. An image forming apparatus comprising:

the feeding device according to claim 4; and an image forming unit that forms an image on a medium fed from the feeding device.

16. An image forming apparatus comprising:

the feeding device according to claim 5; and an image forming unit that forms an image on a medium fed from the feeding device.

17. A feeding device comprising:

a blowing unit that floats a plurality of stacked media by blowing air to side end portions of the media and that has a first blowing unit which blows the air from a defined region to the media and a second blowing unit which blows the air from a changing region to the media;

a feeding unit that feeds the floating media; and a control unit that has a control mode in which the first blowing unit and the second blowing unit simultaneously perform air blowing on the media, wherein the blowing unit has a blowing pipe of the air, a first blowing port serving as the first blowing unit, and a second blowing port serving as the second blowing unit, wherein the first blowing port extends from an upward direction to a downward direction, and the second blowing port extends in a direction intersecting a direction in which the first blowing port extends with respect to a moving member that configures an outlet unit of the blowing pipe and that is movable in an up-down direction.

* * * * *